US009746830B2

(12) United States Patent
Orny et al.

(10) Patent No.: US 9,746,830 B2
(45) Date of Patent: Aug. 29, 2017

(54) DISPLAY MECHANISM

(71) Applicant: Harry Winston SA, Plan-les-Ouates (CH)

(72) Inventors: Franck-Charles-Cyril Orny, La Chaux-de-Fonds (CH); Johnny Frederic Girardin, Fontaines (CH)

(73) Assignee: HARRY WINSTON SA, Plan-les-Ouates (CH)

( * ) Notice: Subject to any disclaimer, the term of this patent is extended or adjusted under 35 U.S.C. 154(b) by 0 days.

(21) Appl. No.: 15/298,057

(22) Filed: Oct. 19, 2016

(65) Prior Publication Data

US 2017/0038732 A1 Feb. 9, 2017

Related U.S. Application Data

(63) Continuation of application No. 14/442,629, filed as application No. PCT/EP2013/073996 on Nov. 15, 2013, now Pat. No. 9,529,329.

(30) Foreign Application Priority Data

Nov. 16, 2012 (CH) ..... 2423/12

(51) Int. Cl.
*G04B 19/247* (2006.01)
*G04B 37/00* (2006.01)
(Continued)

(52) U.S. Cl.
CPC ..... *G04B 37/0083* (2013.01); *G04B 13/02* (2013.01); *G04B 19/202* (2013.01); *G04B 19/247* (2013.01); *G04B 27/002* (2013.01)

(58) Field of Classification Search
CPC G04B 37/0083; G04B 19/202; G04B 19/247; G04B 19/22; G04B 19/23; G04B 13/02; G04B 27/002
See application file for complete search history.

(56) References Cited

U.S. PATENT DOCUMENTS 3,116,593 A * 1/1964 Van Horn ..... G04B 18/028 368/186
3,518,825 A * 7/1970 Nissen ..... G04B 19/25373 368/37
(Continued)

FOREIGN PATENT DOCUMENTS

EP 1 922 591 5/2008
WO 2006 134171 12/2006
(Continued)

OTHER PUBLICATIONS

International Search Report Issued Mar. 28, 2014 in PCT/EP2013/073996 Filed Nov. 15, 2013.

*Primary Examiner* — Sean Kayes
(74) *Attorney, Agent, or Firm* — Oblon, McClelland, Maier & Neustadt, L.L.P.

(57) ABSTRACT

A centralized control unit for controlling an arm moving in a clockwise direction and in a counter-clockwise direction includes an arbor about which the centralized control unit pivots. The arm is integrally mounted on a toothed actuating wheel as an assembly, and the assembly is mounted to freely rotate about the arbor. The centralized control unit also includes a wheel to control the arm in the clockwise direction, a wheel to control the arm in the counter-clockwise direction, and a power wheel kinematically connected to an independent barrel to drive the arm.

13 Claims, 23 Drawing Sheets

(51) Int. Cl.

| | |
|---|---|
| ***G04B 19/20*** | (2006.01) |
| ***G04B 27/00*** | (2006.01) |
| ***G04B 13/02*** | (2006.01) |

(56) References Cited

U.S. PATENT DOCUMENTS

| | | | | |
|---|---|---|---|---|
| 4,660,992 | A | 4/1987 | Paul | |
| 4,796,240 | A | 1/1989 | Stevens | |
| 5,008,869 | A | 4/1991 | Dweck | |
| 5,018,118 | A | 5/1991 | Ross | |
| 5,787,055 | A | 7/1998 | Alpert | |
| 5,844,863 | A | 12/1998 | Voss | |
| 7,177,234 | B1 | 2/2007 | Paul | |
| 7,742,365 | B2 * | 6/2010 | Moteki | G04B 21/06 368/269 |
| 8,339,900 | B2 * | 12/2012 | Muller | G04B 27/005 368/21 |
| 8,374,057 | B2 * | 2/2013 | Journe | G04B 21/12 368/72 |
| 8,879,368 | B2 | 11/2014 | Jacobi, Jr. | |
| 8,891,337 | B2 * | 11/2014 | Le Doussal | G04B 19/262 368/17 |
| 9,021,835 | B2 | 5/2015 | Babyak | |
| 2006/0039243 | A1 | 2/2006 | Seyr | |
| 2007/0008823 | A1 | 1/2007 | Plancon | |
| 2009/0040880 | A1 | 2/2009 | Ruchonnet et al. | |
| 2011/0032802 | A1 * | 2/2011 | Muller | G04B 19/23 368/22 |

FOREIGN PATENT DOCUMENTS

| | | |
|---|---|---|
| WO | 2007 020289 | 2/2007 |
| WO | 2009 030218 | 3/2009 |

* cited by examiner

DISPLAY MECHANISM

CROSS-REFERENCE TO RELATED APPLICATIONS

This application is a continuation of U.S. patent application Ser. No. 14/442,629, filed on May 13, 2015, which is a National Phase Application in the United States of International Patent Application No. PCT/EP2013/073996, filed on Nov. 15, 2013, and which claims priority of Swiss Patent Application No. 02423/12, filed on Nov. 16, 2012. The entire contents of each of the above patent applications are hereby incorporated by reference herein in entirety.

FIELD OF THE INVENTION

The present invention relates to mechanical timepieces. It more particularly concerns a mechanism for the display of several mutually different pieces of time information including several information carriers on each of which appears one of said pieces of time information. The present invention also concerns a timepiece including such a display mechanism.

BACKGROUND OF THE INVENTION

Such a mechanism for the display of several mutually different pieces of time information including several information carriers, on each of which appears one of said pieces of time information, is conventionally used in mechanical timepieces to display, on the dial, various pieces of time information, such as the date, the time in different time zones, phases of the moon, etc . . .

This information is displayed by means of different apertures or symbols distributed over the timepiece dial. Once the timepiece is assembled, the position of the various pieces of information displayed on the dial is immutable, so that it is impossible to modify the appearance of the dial.

Further, all of the pieces of time information consistently appear although the user does not necessarily desire the display thereof.

Further, each information carrier and its actuation mechanism occupy a considerable amount of space underneath the dial, so that the dial and movement are very cluttered, leaving no room for other displays or other mechanisms.

One solution for overcoming this problem was proposed in EP Patent No 1922591 which discloses the use of one or two rotating indicators kinematically connected to cams to "update" the indicators when the associated cams are selected according to the selected type of information to be displayed. The cam is selected by means of a finger-piece which moves in translation to read the information on the cam and transmit it to the associated indicator to "update" it. However, in this display mechanism, the indicators are fixed behind an aperture so that the appearance of the dial cannot be changed. Further, the indicators used are the same regardless of the type of information to be displayed. This means that the information to be displayed must be of the same type.

It is therefore an object of the present invention to overcome these drawbacks by proposing a display mechanism which makes it possible to select the time information to be displayed.

It is another object of the present invention to propose a display mechanism that makes it possible to display different pieces of time information in the same place on the dial, leaving space available for other displays or mechanisms.

SUMMARY OF THE INVENTION

To this end, and according to the present invention, there is proposed a mechanism for the display of several mutually different pieces of time information including several information carriers on each of which appears one of said pieces of time information.

According to the invention, the display device further includes a magazine in which said information carriers are stored in an inactive storage position, a platform arranged to receive, in a movable manner according to the time information to be displayed, the selected information carrier in an active operating position, first means for moving the selected information carrier between said inactive storage position in the magazine and said active operating position on the platform, said first movement means being mounted between the magazine and the platform, and means for controlling said first movement means.

Advantageously, the magazine can include different superposed housings respectively arranged to receive one information carrier. Further, said magazine is mounted to be movable in translation so as to present the selected information carrier level with the first movement means.

Preferably, the display magazine includes first actuation means arranged to move the magazine so as to present the selected information carrier level with the first movement means.

According to a preferred embodiment of the invention, the information carrier includes a disc bearing time information and including first means for positioning said disc on the platform, and a ring in which the disc is mounted for free rotation and including second means for positioning the information carrier in the magazine. The ring may also include housings arranged to receive the selected information carrier movement means.

Advantageously, the means for moving the selected information carrier include an arm mounted to pivot between the magazine and the platform and having means for gripping the selected information carrier.

Advantageously, the platform includes as many crowns as there are pieces of time information to be displayed on the platform, each of said crowns being arranged to receive an associated information carrier and being movable in rotation at a speed selected according to the piece of time information displayed on the associated information carrier.

Preferably, each crown includes third positioning means arranged to cooperate with the first means for positioning the time information bearing disc, the first and third positioning means being arranged such that the time information bearing disc is positioned on the associated crown to correctly display the associated piece of time information.

Preferably, the third positioning means arranged on the crown are movable in translation between a low position for setting the selected information carrier in place on the platform, and a high position permitting cooperation between the selected information carrier and its associated crown. Advantageously, the platform includes second movement means arranged to move the third positioning means arranged on the crown in translation between their low position and high position.

Advantageously, the mechanism according to the invention further includes coupling means arranged to pivot the selected information carrier positioned on the platform until said selected information carrier cooperates with the associated crown.

Advantageously the mechanism includes second means for actuating the coupling means.

Preferably, the control means for said first selected information carrier movement means include a centralised control unit also arranged to control the second means for moving the third positioning means provided on the crown and the second means for actuating the coupling means.

The present invention also concerns a timepiece including a display mechanism as defined above.

This display mechanism makes it possible to select a piece of time information to be displayed, this information may be of a different nature from the other pieces of time information that can be displayed, and to change the appearance of the dial by selecting an information carrier that is different from the other information carriers.

BRIEF DESCRIPTION OF THE DRAWINGS

The invention will be better understood upon reading the following description of one embodiment, given by way of example and made with reference to the drawings, in which.

EMBODIMENT(S) OF THE INVENTION

Figure 1:
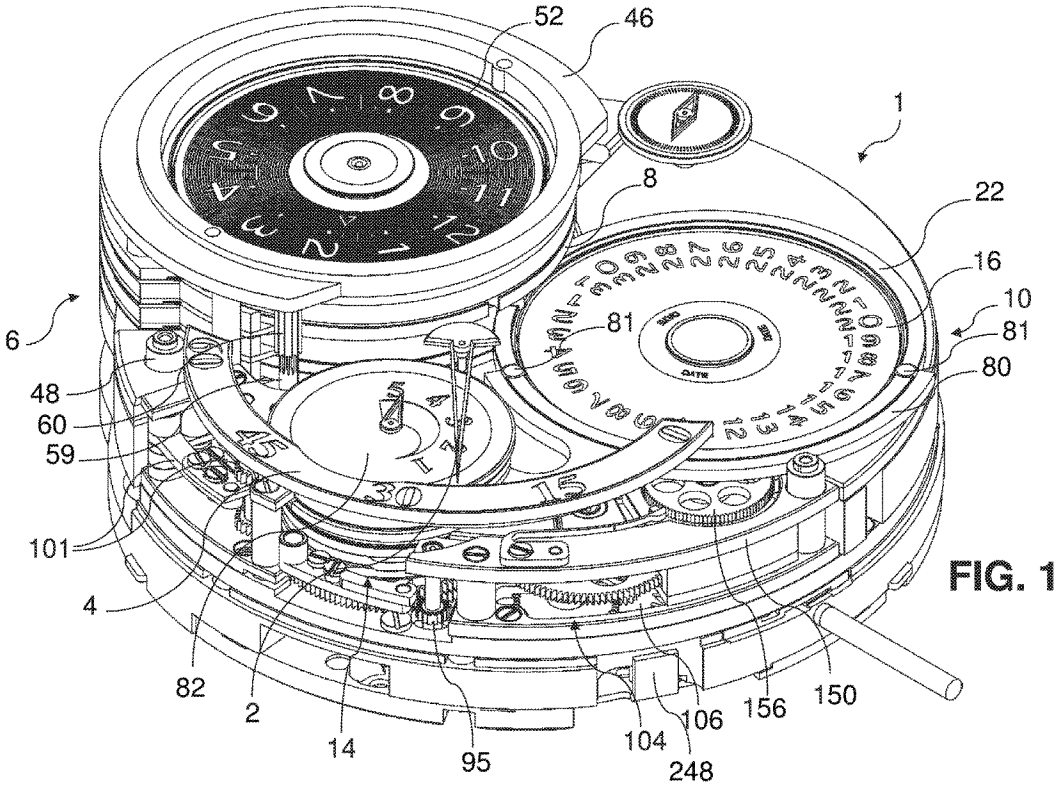
FIG. 1 shows a perspective view of a timepiece movement including elements of a display mechanism according to the invention.
Figure 2:
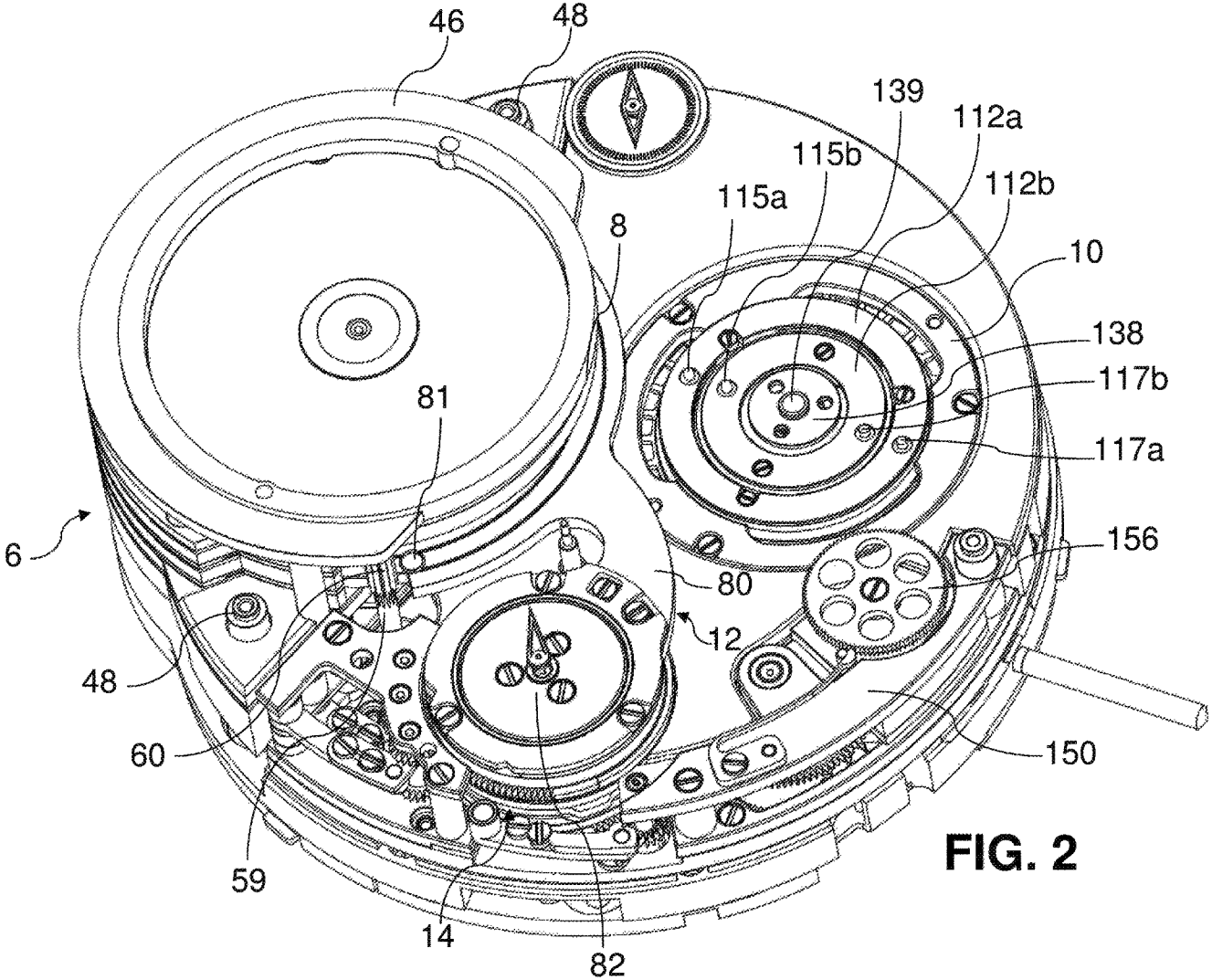
FIG. 2 shows a perspective view of the timepiece movement of FIG. 1 with elements of the upper portion removed.

With reference to FIGS. 1 and 2, there is shown a timepiece movement 1 including a display mechanism according to the invention, and a display of the minutes by means of a retrograde hand 2 and an arc portion 4 bearing the minute graduations.

According to the invention, the display mechanism includes a frame on which are arranged a magazine 6, in which said information carriers 8 are stored in an inactive storage position, a platform 10 arranged to receive, in a movable manner according to the piece of time information to be displayed, the selected information carrier 8 in an active operating position, first means 12 for moving the selected information carrier 8 between said inactive storage position in magazine 6 and said active operating position on platform 10, said first movement means 12 being mounted between magazine 6 and platform 10, and means 14 for controlling said first movement means.

Figures 3A, 3B, 3C:
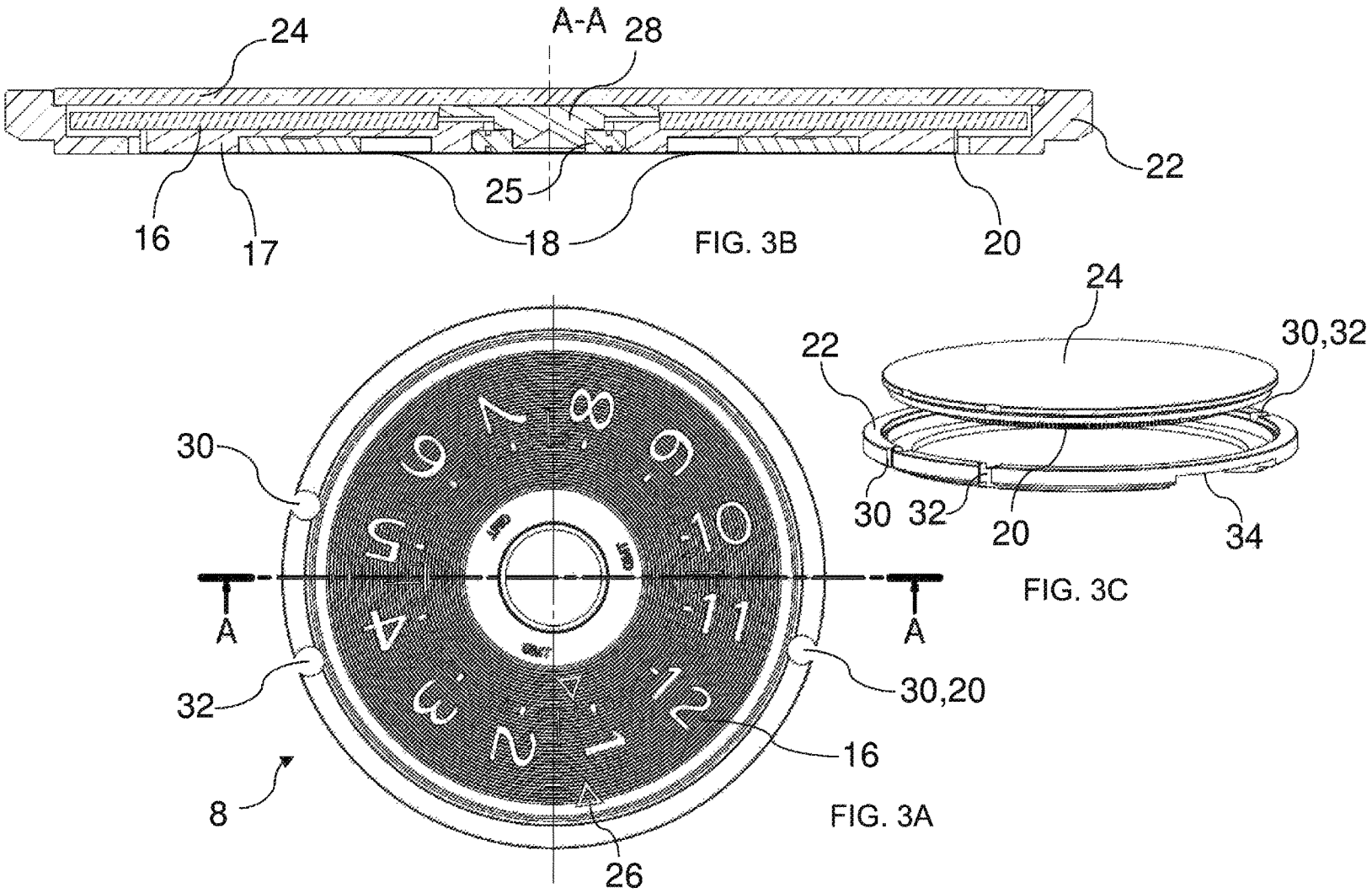
FIGS. 3A, 3B and 3C respectively show a top view, a cross-sectional view along the axis AA and a perspective view of an information carrier used in the invention.

More specifically, with reference to FIGS. 3A, 3B, 3C, each information carrier 8 includes a disc 16 bearing a piece of time information. The piece of time information may be represented in the form of graduations, numbers or any other suitable form and may correspond, for example, to a time in a time zone, a date, a moon phase, etc . . . Symbols identifying the piece of time information to be displayed are provided on the glass of the information carrier. It is clear that the reverse configuration is possible, with the piece of time information being represented in the form of an indicator on disc 16, such as a hand and graduations being provided on the glass of the information carrier. Further, disc 16 may take the form of a solid disc or a disc having a central aperture to form a ring coaxial with the other information carriers. Information carriers in the form of several concentric rings may be used, for example, for the display of a large date, with the numbers of the tens and units being positioned on two different rings. The platform is thus arranged to rotate the rings simultaneously at their respective speed. The rings may also bear any appropriate motif so that the respective driving thereof by the platform forms an animation.

The time information bearing disc is integral with a base 17 including on the bottom thereof, facing outwards, first means for positioning said time information bearing disc 16 on platform 10. Said first means for positioning said time information bearing disc 16 on platform 10 are advantageously formed by an oblong aperture and by a circular orifice respectively able to receive a drive pin and an indicator pin arranged on platform 10 as will be seen below. Base 17 also includes a circular groove 18 arranged to permit free motion of the drive and indicator pins corresponding to another information carrier.

Base 17 also includes an external peripheral toothing 20 whose function will be described below.

Information carrier 8 also includes a ring 22 inside which time information bearing disc 16 and its base 17 are arranged. The assembly is closed by means of a glass 24 on which are shown symbols 26 for identifying the piece of time information to be displayed.

Time information bearing disc 16 and its base 17 are mounted for free rotation inside ring 22 about an arbor 28 integral with glass 24 by means of a ball bearing 25.

Ring 22 includes housings forming second means 30 for positioning information carrier 8 in magazine 6.

Ring 22 further includes housings 32 arranged to receive the first means 12 for moving the selected information carrier 8.

Corresponding cut-outs portions are provided in glass 24.

Ring 22 also includes a cut-out portion 34 arranged to allow the passage of the means for coupling disc 16 as will be described below.

Figure 4A:
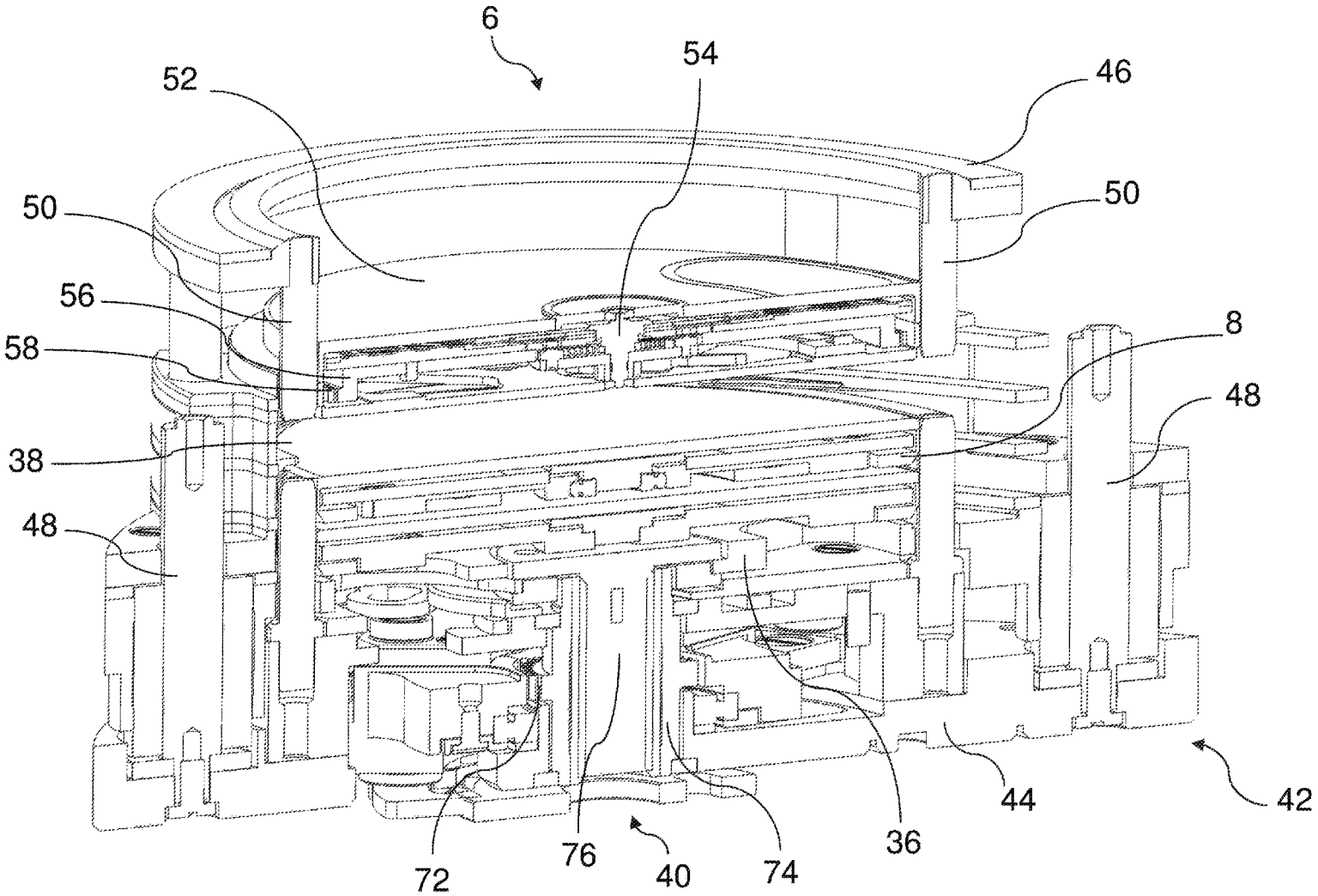
FIG. 4A shows a cross-sectional view of the magazine used in the invention, with one of the information carriers removed from said magazine.
Figure 4B:
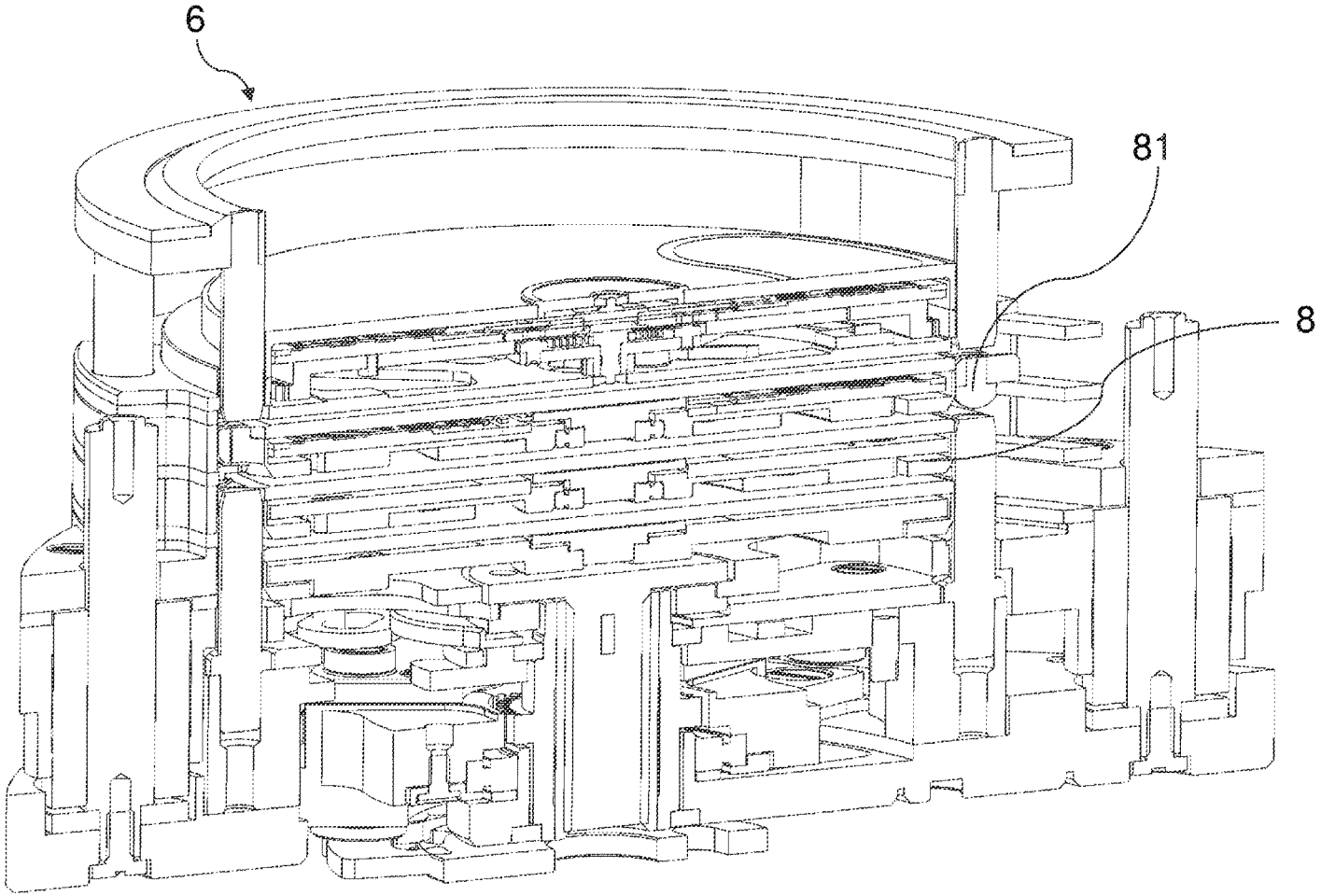
FIG. 4B shows a cross-sectional view of the magazine used in the invention, all of the information carriers being in their inactive position.

With reference to FIGS. 4A and 4B, magazine 6 includes a plate 26 on which are superposed various housings 38 respectively arranged to receive an information carrier 8. Underneath plate 36 are arranged first actuation means 40 arranged to move magazine 6 so as to present the selected information carrier 8 level with the first movement means. Said first actuation means 40 will be described below.

The movement includes a fixed frame 42 inside which said magazine 6 is mounted to move in translation perpendicular to the general plane of the movement, so as to be capable of moving and presenting the selected information carrier 8 level with the first movement means. It is clear that the magazine may be arranged to be movable in an inclined plane with respect to the general plane of the movement.

More specifically, fixed frame 42 includes a lower bridge 44, an intermediate bridge (not shown) and an upper bridge 46 integral with the frame.

Fixed frame 42 also includes a first set of pins 48 mounted between lower bridge 44 and the intermediate bridge, along which slides plate 36 of magazine 6 perpendicularly to the general plane of the movement. Fixed frame 42 also includes a second set of pins 50 mounted between lower bridge 44 and upper bridge 46. Plate 36 of magazine 6 and information carriers 8 are arranged to slide perpendicularly to the general plane of the movement along said second set of pins 50, said pins 50 being inserted, in particular, into housings 30 provided on ring 22 of information carrier 8. Further, each pin 50 is discontinuous in order to form a passage and permit the extraction of selected information carrier 8 from magazine 6 as shown more specifically in FIG. 4A.

At the top of magazine 6 there is an information carrier 52 mounted to move in rotation about an arbor 54 mounted in the upper housing of magazine 6. This information carrier 52 is, for example, a disc including graduations for displaying the local time by means of a symbol provided on the glass protecting said disc. Said information carrier 52 moves in translation with the other informations carriers 8 stored in magazine 6, but remains in its housing.

Said information carrier 52 is integral with a crown 56 having an external toothing 58. There is also provided on fixed frame 42 an arbor 59 (visible in FIGS. 1 and 2) mounted to pivot and including, at the upper end thereof, a pinion 60 meshing with the external toothing 58 of crown 56 and at the lower end, a first element of a set of intermediate wheels kinematically connected to an hour wheel for rotating information carrier 52 at the speed of the hours. Pinion 60 is sufficiently long for the external toothing 58 of crown 56 to remain meshed with said pinion 60 when information carrier 52 slides with magazine 6.

Figure 5:
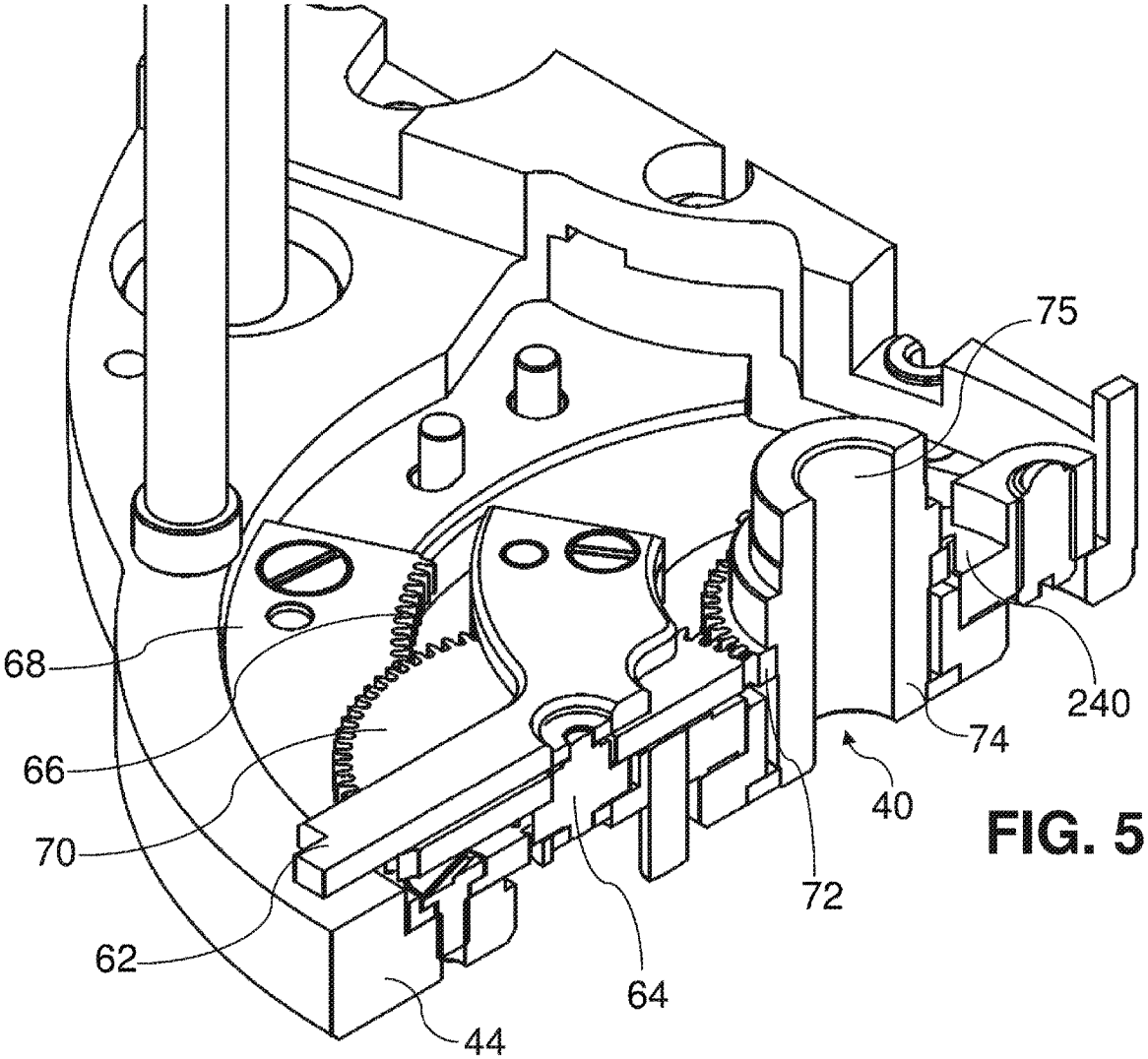
FIG. 5 shows a partial perspective view of the first actuation means.

With reference to FIG. 5, the first actuation means 40 arranged to move magazine 6 include a selection arm 62 accessible to a user and integral with a main plate 240 which is mounted to pivot on fixed frame 42, so that the angular motion of selection arm 62 causes the translational motion of plate 36 of magazine 6. To this end, there is provided a gear reduction train including a pinion 64 mounted to pivot on plate 240. Said pinion 64 meshes with an inner toothing 66 of a fixed wheel 68 arranged on the frame and is also integral with a toothed wheel 70 cooperating with a toothed wheel 72 integral with a nut 74 having an inner thread 75. There is also provided, integral with plate 36, a screw 76 having an external thread arranged to cooperate with internal thread 75 of nut 74.

Thus, an angular motion of selection arm 62 causes an angular motion of pinion 64 which, cooperating with toothing 66 pivots on its axis, driving in rotation toothed wheel 70, which in turn drives in rotation toothed wheel 72 and nut 74. The rotation of nut 74 causes the translational motion of screw 76 and thus of plate 36 and of magazine 6.

With reference to FIGS. 2 and 5, first means 12 for moving selected information carrier 8 include an arm 80 pivotally mounted between magazine 6 and platform 10, said arm 80 having means for the gripping selected information carrier 8 arranged to extract the selected information carrier from its housing 38 in magazine 6. More specifically, arm 80 has the shape of a fork with two branches, whose ends have protruding portions 81 arranged to be housed in housings 32 provided on ring 22 of information carrier 8. The branches of arm 80 are sized to be positioned around ring 22 of selected information carrier 8. Advantageously, one or two of housings 30 used for positioning information carrier 8 in magazine 6 by means of pins 50 may also be used as housings 32 for housing one or two of protruding portions 81 of arm 80.

Arm 80 is driven by means of an independent barrel 234 (cf. FIG. 14), and actuated by means of a push-piece 248 (cf. FIGS. 1 and 14), or any other suitable means. At the centre of arm 80 there is a cycle reserve 82 arranged to indicate the reserve of the barrel of arm 80. One cycle corresponds to the exit of one information carrier 8 and its return inside magazine 6. The display of cycle reserve 82 is a dragging display.

Arm 80 is integrally mounted on a toothed actuating wheel 84, the assembly being mounted for free rotation about an arbor 86 mounted on the frame, said arbor 86 being the arbor about which a centralised control unit 88 pivots. This centralised control unit 88 includes, integrally connected, in particular a wheel for controlling the arm in the clockwise direction 90, a wheel for controlling the arm in the counter-clockwise direction 92, and a power wheel 94 kinematically connected to the independent barrel driving arm 80 via a pinion 95 visible in FIG. 1.

The wheels controlling the arm in the clockwise direction 90 and in the counter-clockwise direction 92 respectively include a 60° toothed sector arranged such that the motion of arm 80 corresponds to a 60° rotation of said control wheels.

There is also provided a set of reverser pinions for rotating actuating wheel 84 of arm 80 in the clockwise or counter-clockwise direction. This set includes a set of two integral pinions mounted for free rotation on the frame, namely a pinion 96 arranged to cooperate with the toothed sector of the wheel controlling the arm clockwise 90 and a pinion 98 arranged to cooperate with actuating wheel 84 of arm 80. There is also provided a pinion 100 mounted for free rotation on the frame and arranged to cooperate, on the one hand with a toothed sector of the wheel controlling the arm counter-clockwise 92, and on the other hand with another pinion 102 mounted for free rotation on the frame and arranged to cooperate with actuating wheel 84 of arm 80. The toothed sectors of the wheels controlling the arm clockwise 90 and counter-clockwise 92 are arranged so that when one of the toothed sectors arrives in front of the corresponding pinion of the reverser assembly, the other toothed sector does not cooperate with the corresponding pinion of the reverser assembly.

There is provided, on the arbor of pinions 96-98 and on the arbor of pinion 100, a flat portion 97 arranged to cooperate respectively with a positioning lever 101 (visible in FIG. 1) mounted to pivot on the frame. The positioning lever has a flat lateral edge arranged to cooperate with flat portion 97 in order to pivot pinions 96-98 and 100 to reposition them perfectly when the cycle has finished.

The centralised control unit 88 is regulated by means of a regulating mechanism 104 of the escapement regulator type (visible in FIG. 1) including a train of intermediate wheels of which a first element meshes with power wheel 94, and the last element meshes with an escape wheel 106 cooperating with a pallet lever. This type of mechanism is known to those skilled in the art and no further details are required.

Centralised control unit 88 also includes a safety wheel 108 including two teeth acting like a cam to actuate a jumper spring (not shown) to release all pressure on arm 80 during its movement and to reposition it pressing on arm 80 so as to ensure the proper positioning of arm 80 when information carrier 8 is in an active or inactive position.

According to another variant embodiment shown in FIGS. 9 to 13, there is provided a first safety device for ensuring the holding in position of the first movement means 12 and more specifically of arm 80 when information carrier 8 is in an active or inactive position. To this end, the safety device includes a safety lever 200 arranged to manoeuvre between an activated position in which it exerts pressure on arm 80 to hold it in position once said arm 80 has placed information carrier 8 in an active or inactive position and a deactivated position in which it leaves arm 80 free to move to place information carrier 8 in an active or inactive position. The safety device also includes means for activating said safety lever 200 arranged to position it in its activated position and means for deactivating said safety lever to position it in its deactivated position. More specifically with reference to FIG. 10, the safety device includes a bridge 202 on one side of which safety lever 200 is pivotally mounted. The lever includes at each end thereof a nose 200*a*, 200*b*, whose shape is selected to allow the best possible contact with a pin 204, 206 respectively provided on arm 80 (cf. FIGS. 9, 12 and 13). Further, the safety lever includes an additional lateral branch 200*c* having the shape of a rack whose function will be described below. Safety lever 200 is also provided with a jumper spring 208.

Figure 11:
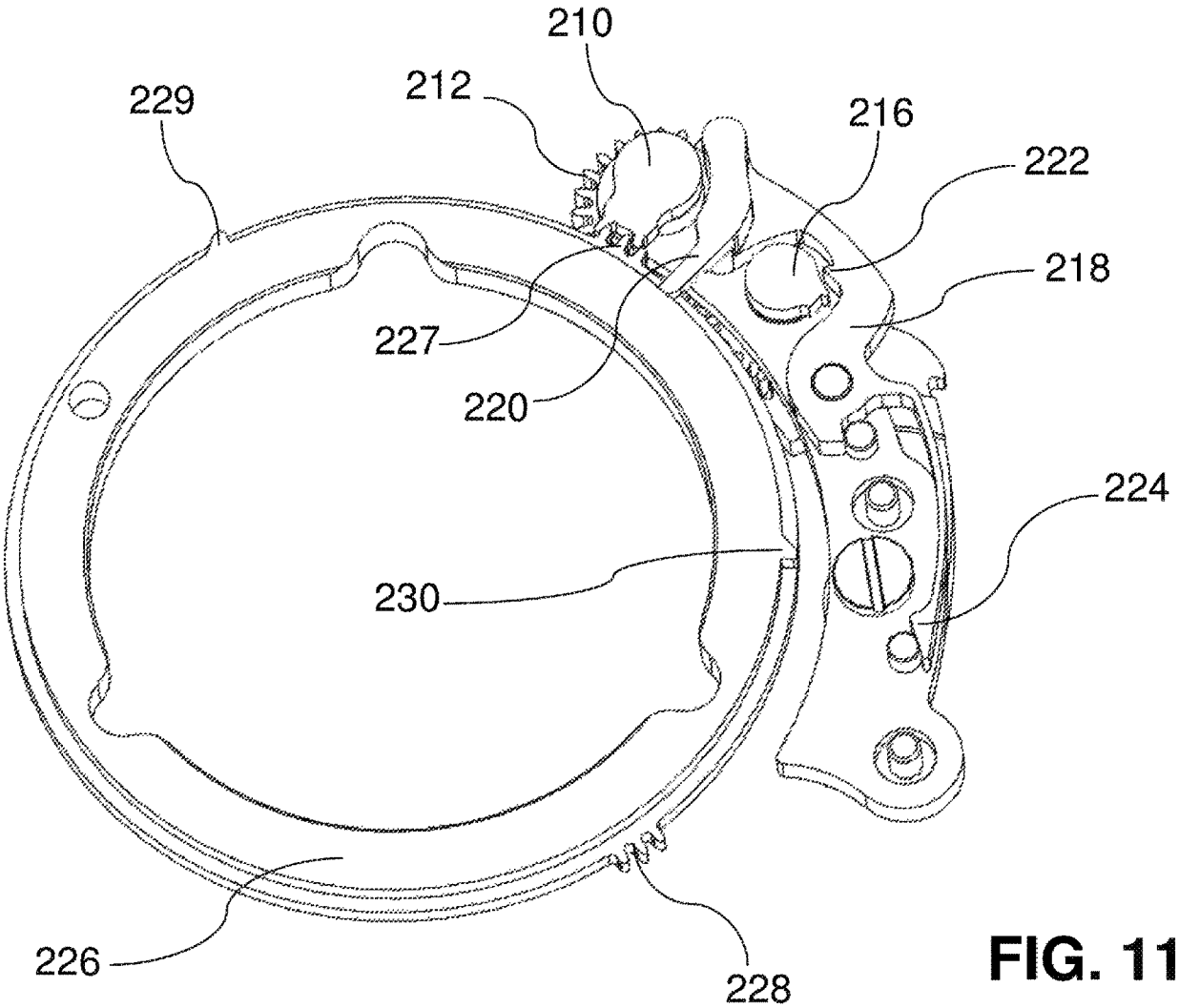

The means for activating safety lever 200 include an activating pinion 210 provided with a toothed sector pivotally mounted on bridge 202 on the opposite side to safety lever 202 ,and two pinions 212, 214 pivotally mounted on the bridge on the same side as the safety lever, the first pinion 212 being integral with activating pinion 210 and the second pinion 214 cooperating, on the one hand with first pinion 212, and on the other hand with the rack of the additional branch 200*c* of safety lever 200. As shown in FIG. 11, the activating means also include an activating cam 216 mounted to pivot on bridge 202 on the same side as activating pinion 210, said activating cam 216 being integral with second pinion 214.

With reference to FIG. 11, the deactivating means include a deactivating lever 218 pivotally mounted on bridge 202 on the same side as activating pinion 210. The deactivating lever 218 includes a deactivating finger-piece 220 whose function will be described below. Deactivating lever 218 also includes a beak 222 arranged to cooperate with and lock activating cam 216. Deactivating lever 218 is provided with a jumper spring 224.

Figure 10:
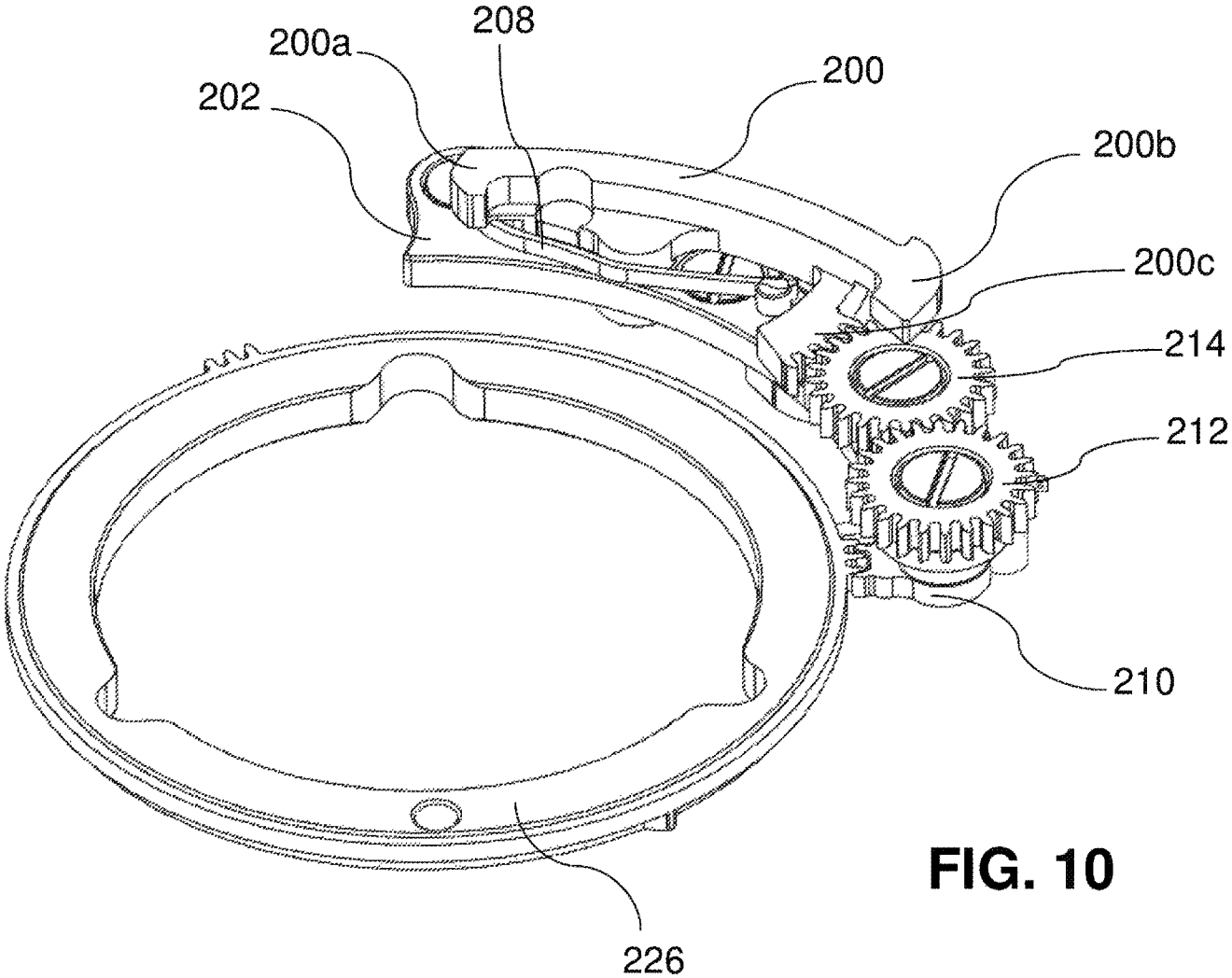
FIGS. 10 and 11 respectively show a top view and a bottom view of a first safety device for ensuring the holding in position of the first movement means.

Further, as shown in FIG. 10, centralised control unit 88 includes a safety wheel 226 including toothed sectors 227, 228 arranged to cooperate with the toothed sector of activating pinion 210 and two teeth 229, 230 arranged to cooperate with deactivating finger-piece 220 of deactivating lever 218. Toothed sectors 227, 228 and teeth 229, 230 are distributed over safety wheel 226 so as to start the safety device at appropriate times.

Figure 12:
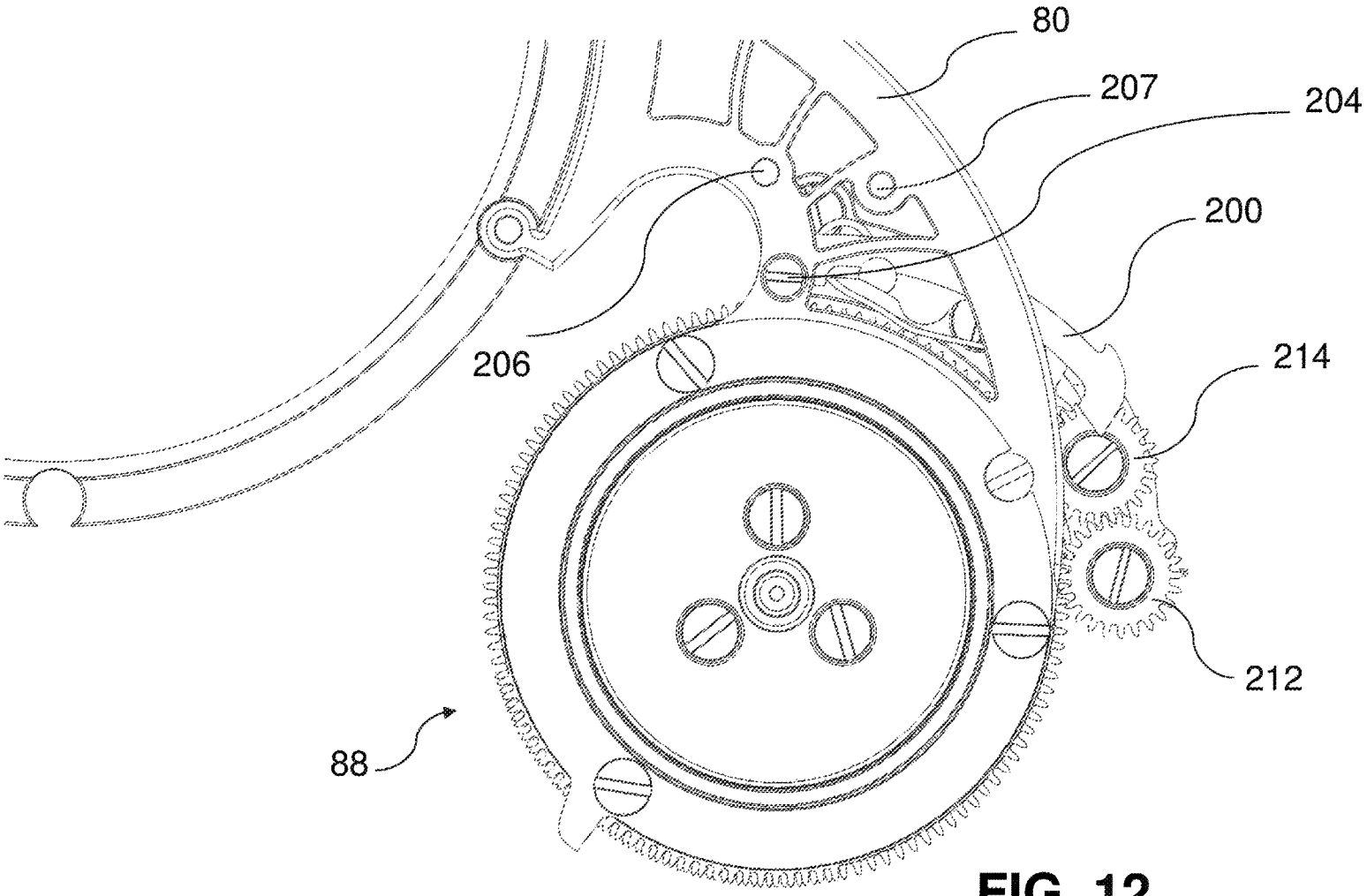
FIGS. 12 and 13 respectively show said first safety device when the information carrier is in an inactive position and when the information carrier is in an active position.
Figure 13:
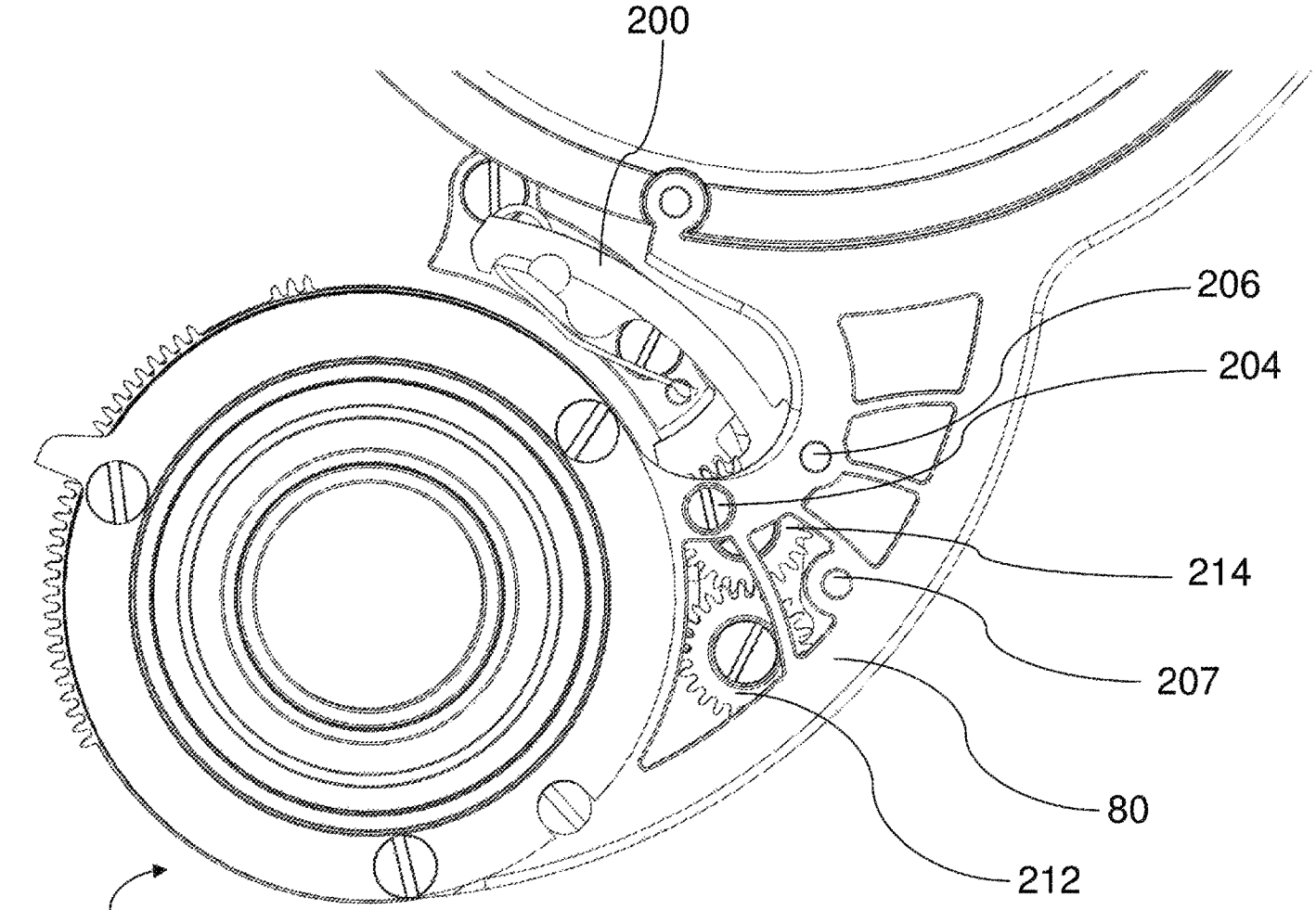

The operation of the safety device is as follows: with reference to FIG. 12, when arm 80 is placed in front of magazine 6, the information carrier being in an inactive position, safety lever 200 is in an activated position, with its nose 200*a* bearing on pin 204 so as to hold arm 80 in this position. Activating cam 216 is locked by beak 222 so that the entire activating mechanism is locked, and therefore also rack 200*c*. Accordingly, safety lever 200 is immobilised against arm 80. When the user has started a cycle, safety wheel 226 rotates so that one of teeth 229, 230 cooperates with deactivation finger-piece 220 so as to lift deactivating lever 218 and thereby release activating cam 216. The activating mechanism is thus no longer locked so that rack 200*c*, and therefore safety lever 200, falls into its deactivation position. Arm 80 can thus be released and pivot. When arm 80 is positioned in front of platform 10 to place the information carrier in an active position, safety wheel 226 rotates so that one of toothed sectors 227, 228 cooperates with activating pinion 210 to cause it to pivot. The rotation of activating pinion 210 causes the rotation of first pinion 212 and therefore of second pinion 214, and thus of activating cam 216 on the one hand and rack 200*c* of safety lever 200 on the other hand. Security lever 200 is raised to reposition its nose 200*b* against pin 206 and to bear on safety lever 200 to hold it in position, as shown in FIG. 13. At the same time, activating cam 216 pivots until it cooperates with and locks beak 222 of deactivating lever 218, so that the safety device is activated and locked. Then the same cycle of activation and deactivation starts again.

The other elements of centralised control unit 88 will be described below.

Figure 7:
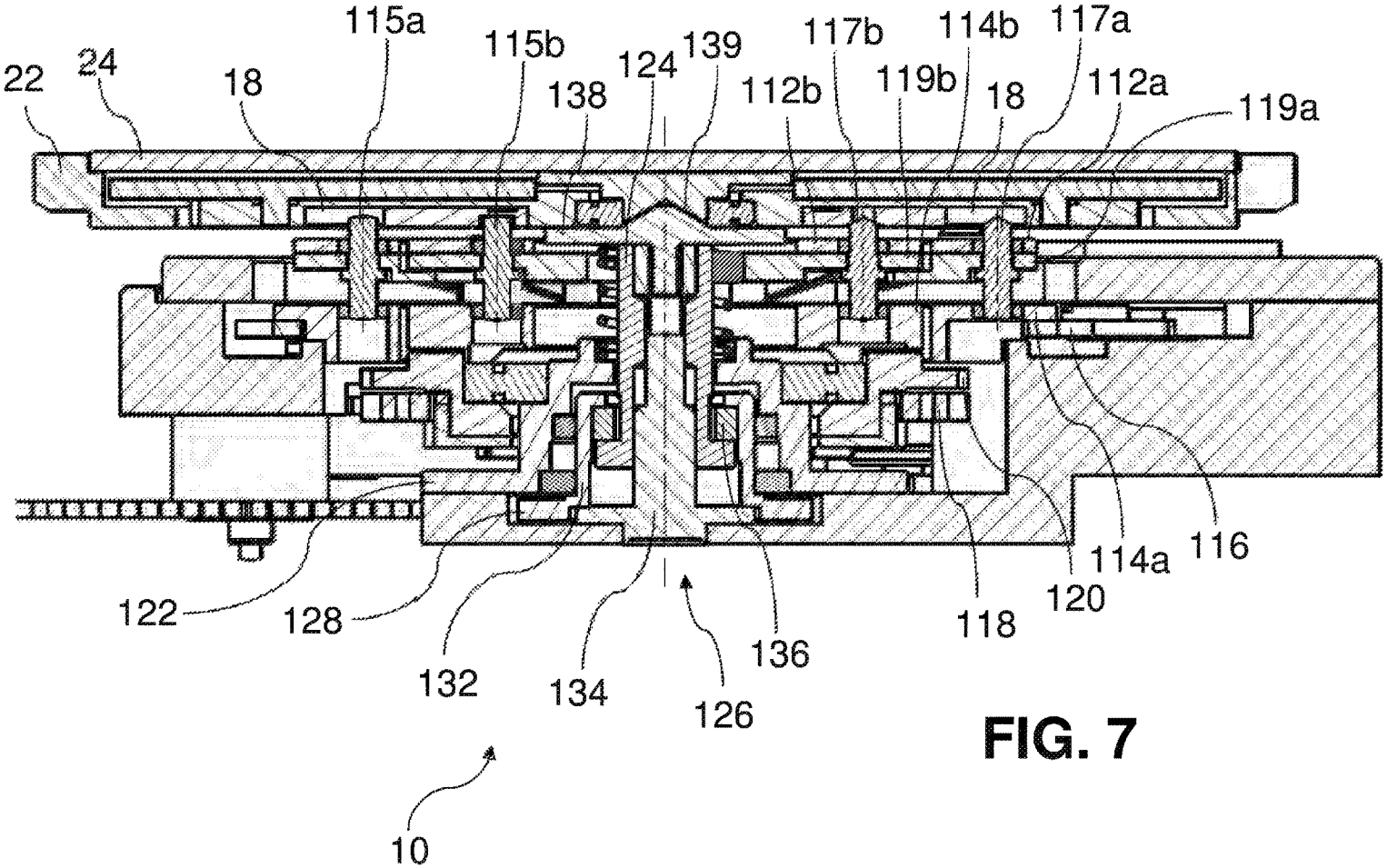
FIG. 7 shows a cross-sectional view of the platform on which is positioned an information carrier.

With reference to FIGS. 2 and 7, platform 10 includes as many concentric crowns 112 as there are pieces of time information to be displayed on platform 10, each of said crowns 112 being arranged to receive an associated information carrier 8. Further, each crown 112 is always rotatably movable at a speed selected according to the piece of time information displayed on the associated information carrier 8. To achieve this, each crown 112 is integral with an annular plate 114 which is in turn integral with a drive wheel kinematically connected to the mechanism corresponding to the selected piece of information and enabling annular plate 114, and thus crown 112, to be be driven at the appropriate speed. For example, crown 112*a* is the crown used for carrying the information carrier displaying the date, and is integral with annular plate 114*a*, in turn integral with a drive crown 116 kinematically connected to the date wheel of the movement. Crown 112*b* is the crown used to carry the information carrier displaying the time in a time zone different from the local time, and is integral with annular plate 114*b*, in turn integral with a drive crown 118 kinematically connected to the time zone hour wheel. A mechanism for correcting this time may be provided and includes, in particular, a corrector crown 120.

Further, each crown 112 includes third positioning means arranged to cooperate with the first means for positioning the time information bearing disc, the first and third positioning means being arranged such that the time information bearing disc 16 is positioned on the associated crown 112 to correctly display the associated piece of time information.

As seen above, said third positioning means provided on crowns 112*a*, 112*b* are advantageously formed by a drive pin 115*a*, 115*b* arranged to cooperate with the oblong aperture provided on base 17 of disc 16 and by an indicator pin 117*a*, 117*b* arranged to cooperate with the circular orifice provided on base 17 of disc 16.

The third positioning means arranged on crowns 112*a*, 112*b* are movable in translation between a low position for setting the selected information carrier 8 in place on platform 10, and a high position permitting cooperation between the selected information carrier 8 and its associated crown 112*a*, 112*b*.

More specifically, between each crown 112*a*, 112*b* and its associated annular plate 114*a*, 114*b*, there is provided an intermediate ring 119*a*, 119*b* rotatably integral with crown 112*a*, 112*b* and the associated plate 114*a*, 114*b*, but free to move in translation perpendicularly to the general plane of the movement between said crown 112*a*, 112*b* and said associated annular plate 114*a*, 114*b*.

Likewise, drive pins 115*a*, 115*b* and indicator pins 117*a*, 117*b* are free to move in translation perpendicularly to the general plane of the movement between said crown 112*a*, 112*b* and said associated annular plate 114*a*, 114*b* between said low position and said high position.

Drive pins 115*a*, 115*b* and indicator pins 117*a*, 117*b* are mounted to traverse their respective intermediate ring 119*a*, 119*b* and include an annular rim to make them integral with the associated intermediate ring 119*a*, 119*b*.

These various crowns and the associated annular plates and intermediate rings are rotatably mounted about an arbor 122 integral with the frame and with a coaxial arbor 124. which is in turn movable in translation perpendicularly to the general plane of the movement.

Arbor 124 carries an integral central plate 128 which includes an upper shoulder 139 on which is positioned arbor 28 of disc 16, its ball bearing 25 being positioned around said upper shoulder 139. Drive pins 115*a*, 115*b* and indicator pins 117*a*, 117*b* are either engaged in the oblong aperture and the circular orifice arranged on base 17 of the associated disc 16, or in the circular groove 18 of the disc which is not associated therewith, in which said drive pins 115*a*, 115*b* and indicator pins 117*a*, 117*b* can move freely.

Central plate 138 extends above the inner periphery of intermediate ring 119*b*. The external periphery of intermediate ring 119*b* extends above a shoulder arranged on the inner periphery of intermediate ring 119*a*. Plates 119*a*, 119*b* and 138 are free in relation to each other. Thus, when arbor 124 moves in translation downwards, central plate 138 bears on intermediate ring 119*b* which bears on ring 119*a* so that drive pins 15*a*, 115*b* and indicator pins 117*a*, 117*b* descend into the low position.

A strip spring 121 is respectively provided for raising each of intermediate rings 119*a*, 119*b* when central plate 138 is no longer exerting pressure, so that drive pins 115*a*, 115*b* and indicator pins 117*a*, 117*b* rise again into the high position.

The translational motion, perpendicular to the general plane of the movement, of drive pins 115*a*, 115*b* and indicator pins 117*a* 117*b* between their low position and high position is achieved by means of second movement means provided on platform 10.

Said second movement means 126 include intermediate rings 119*a*, 199*b*, arbor 124 and its central plate 138 and a toothed crown 128 arranged to cooperate, via necessary intermediate wheels, with a control wheel 130 of platform 10 integral with the other control wheels of centralised control unit 88. Control wheel 130 of platform 10 includes four 30° toothed sectors distributed over said control wheel 130 of platform 10 so that a 30° rotation of control wheel 130 of platform 10 causes drive pins 115*a*, 115*b* and indicator pins 117*a*, 117*b* to rise to the high position or descend to the low position when toothed crown 128 is kinematically connected to the toothed sectors of control wheel 130 of platform 10.

Toothed crown 128 is integral with a tube 132 rotatably mounted about an arbor 134 fixed to the frame and coaxial with arbor 122 and with arbor 124 about which it is mounted. Tube 132 includes on its inner periphery a helical cam 136 arranged to cooperate with a helical cam provided on the external periphery of arbor 124. Thus, a rotation of toothed crown 128 causes a translational motion, perpendicularly to the general plane of the movement, both upwards and downwards, of arbor 124 which is slidably mounted on arbor 134 and thus a translational motion, perpendicular to the general plane of the movement, of central plate 138.

To aid the positioning of the selected information carrier 8 on platform 10, the mechanism according to the invention further includes coupling means arranged to pivot the selected information carrier 8 positioned on platform 10 until said selected information carrier 8 cooperates with the associated crown 112*a*, 112*b*.

Figure 8:
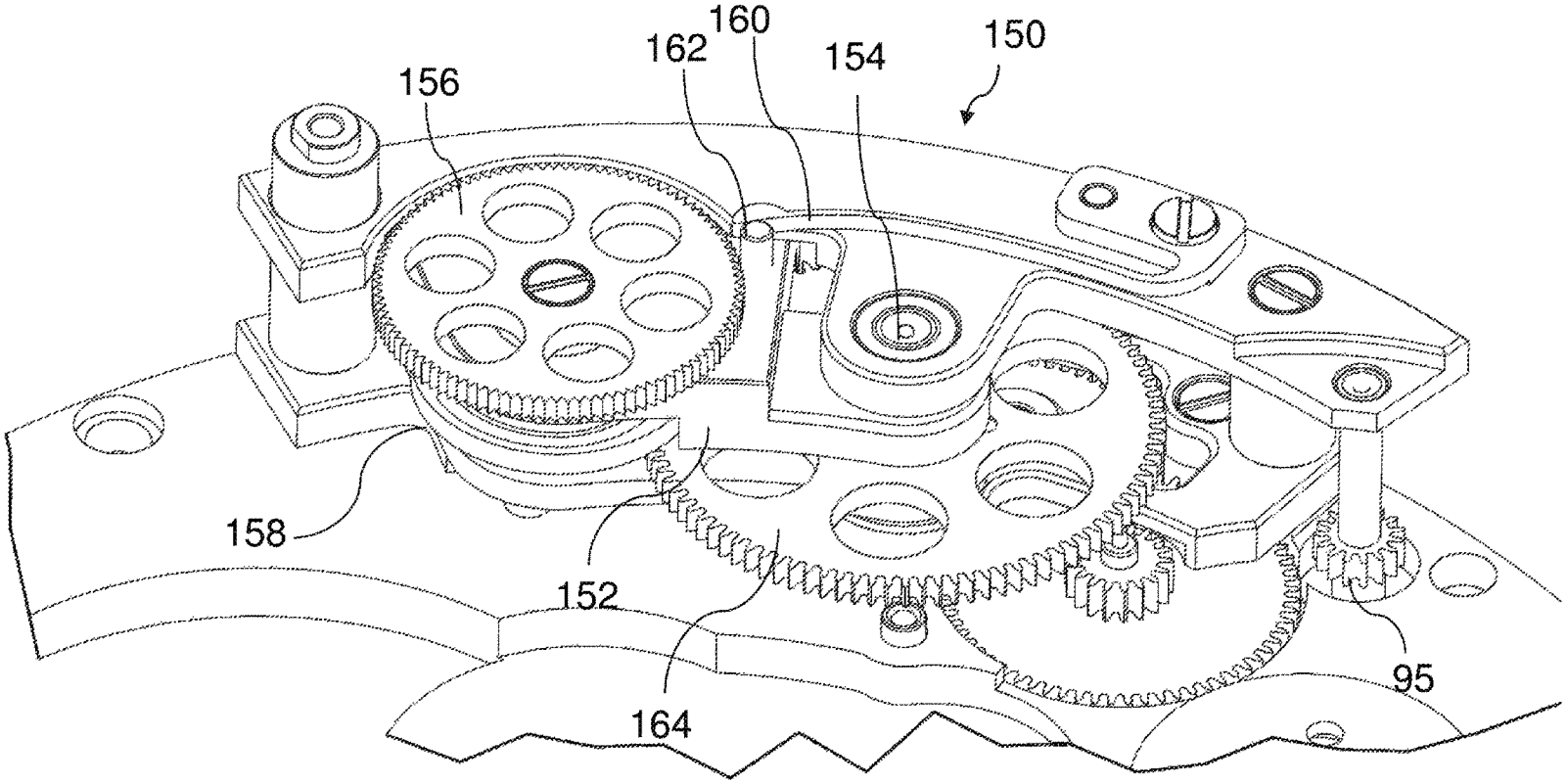
FIG. 8 shows a perspective view of the coupling means.
Figure 9:
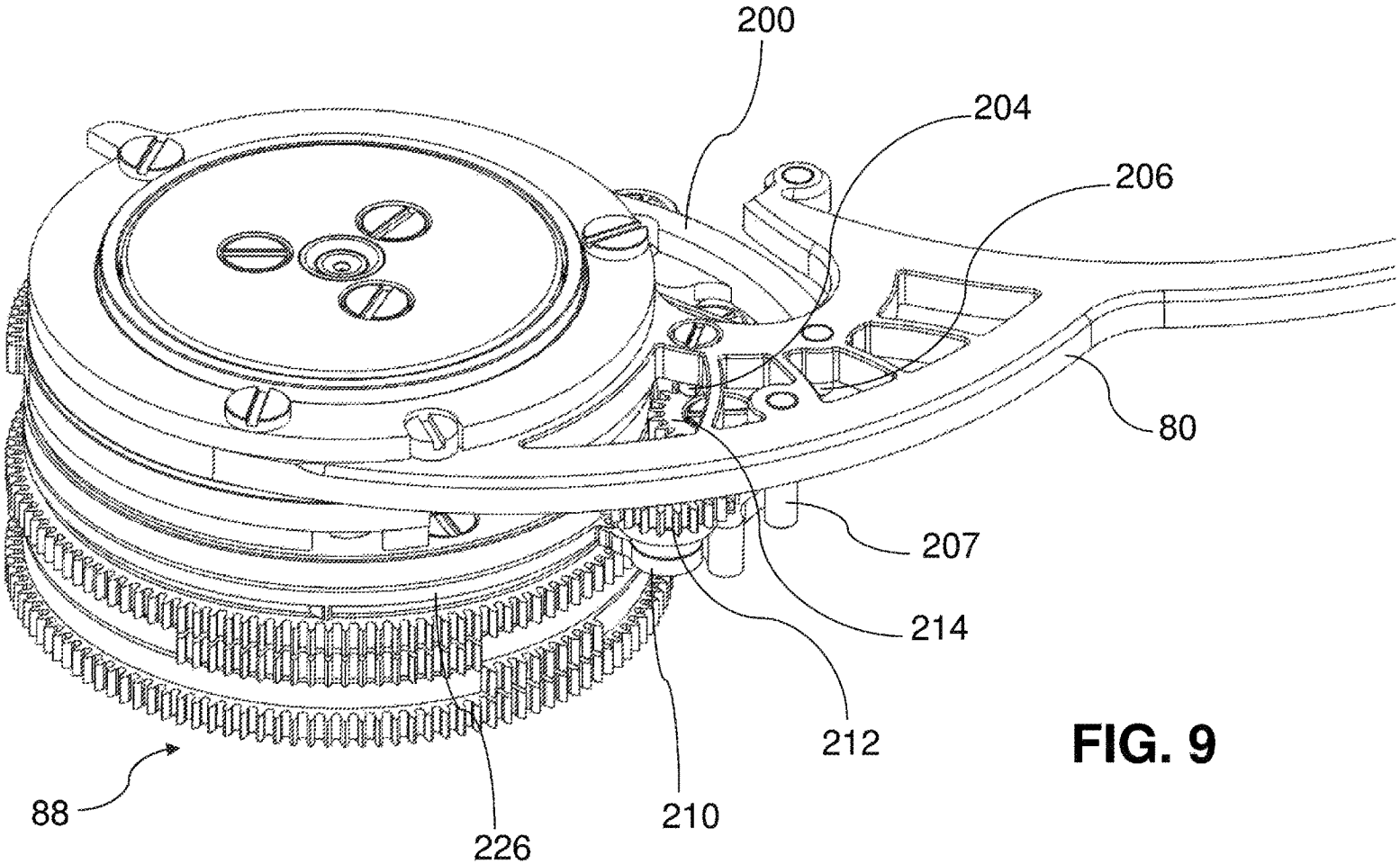
FIG. 9 shows a perspective view of the control unit and of first safety device for ensuring the holding in position of the first movement means.

With reference to FIG. 8, said coupling means include a coupling structure 150 integral with the frame of the movement and a lever element 152 pivotally mounted on coupling structure 150 about an arbor 154. On lever element 152 are pivotally mounted a coupling pinion 156 and a first element of a train of intermediate wheels connected to coupling pinion 156 by means of a friction system 158. Coupling pinion 156 is arranged to engage in the cut-out portion 34 arranged on ring 22 of information carrier 8 and to mesh with external peripheral toothing 20 provided on the base of disc 16. Lever element 152 allows coupling pinion 156 to tip slightly and move away to enable the selected information carrier 8 to be positioned on platform 10.

A jumper spring 160 provided on coupling structure 150 cooperates with a pin 162 provided on lever element 152 to ensure the positioning of coupling pinion 156.

The intermediate wheel train also includes wheel 164 mounted on coupling structure 150 and kinematically connected to the second means of actuating the coupling means. Said second means for actuating the coupling means are advantageously formed by a coupling control wheel 166 integral with the other control wheels of the centralised control unit 88. Coupling control wheel 166 includes a 120° toothed sector so that a 120° rotation of coupling control wheel 166 causes at most a 400° rotation of disc 16, until drive pins 115*a*, 115*b* and indicator pins 117*a*, 117*b* are correctly positioned in the associated disc so that the latter cooperates with its associated crown 112*a*, 112*b*.

According to a variant that is not shown, the disc can include, on its lower face, pins representing a melody and the platform can include a comb arranged to cooperate with the pins to form a melody, in a similar manner to a music box. Different discs may be provided in order to propose different melodies. In such case, the platform is adapted so that the disc is driven only by the coupling means.

The different toothed sectors of the control wheels are arranged in relation to each other according to the evolution of the exit and return cycle of the selected information carrier 8 from the magazine.

This cycle occurs as follows: the user actuates selection arm 62 to move in translation magazine 6 and to bring the selected information carrier 8 level with arm 80 so that its protruding portions 81 engage in housings 32 provided on ring 22 of the information carrier. If the cycle reserve is sufficient, the cycle starts when the user actuates means for starting the mechanism such as push-piece 248 which starts the unwinding of barrel 234 and thus the powering of centralised control unit 88 by power wheel 94.

Figure 14:
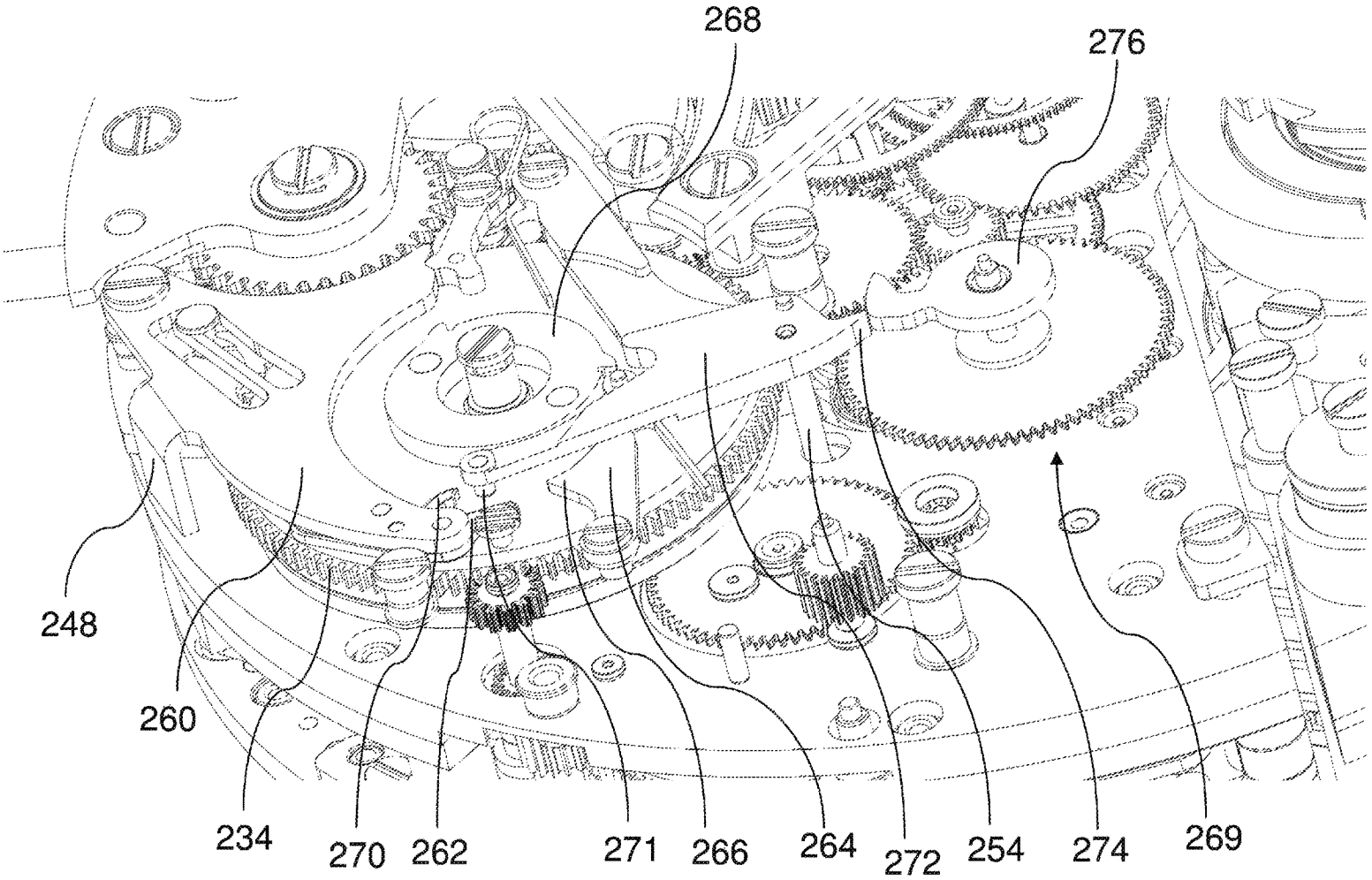
FIG. 14 shows a perspective view of the means for starting the display mechanism.

According to a preferred embodiment of the means for starting the display mechanism shown in FIG. 14, said means for starting the display mechanism according to the invention include push-piece 248 integral with a lever element 260 one arm of which includes a first beak 262, a locking lever 264 including a nose 266 arranged to cooperate with beak 262 and a locking cam 268 of barrel 234 arranged to cooperate with locking lever 264. When the users presses push-piece 248, beak 262 cooperates with nose 266 of locking lever 264 which is raised so that locking cam 268 is released and allows the rotation of barrel 234.

The display mechanism start means are also arranged to cooperate with a power reserve 269. To this end, the arm of lever element 260 includes a second beak 270 to cooperate with a pin 271 provided at the end of an arm of a power reserve lever element 272. Another arm 274 of said power reserve lever element 272 cooperates with a power reserve cam 276. When the power reserve is exhausted, power reserve cam 276 is positioned such that power reserve lever element 272 pivots to position its pin 271 on the travel of second beak 270. Thus, when the user presses push-piece 248, second beak 270 enters into contact with pin 271 which prevents first beak 262 moving as far as locking lever 264 and thus uncouples the mechanism start means.

Further, power reserve lever 272 is integral with a second pin 254 whose function will be described below.

Figure 6:
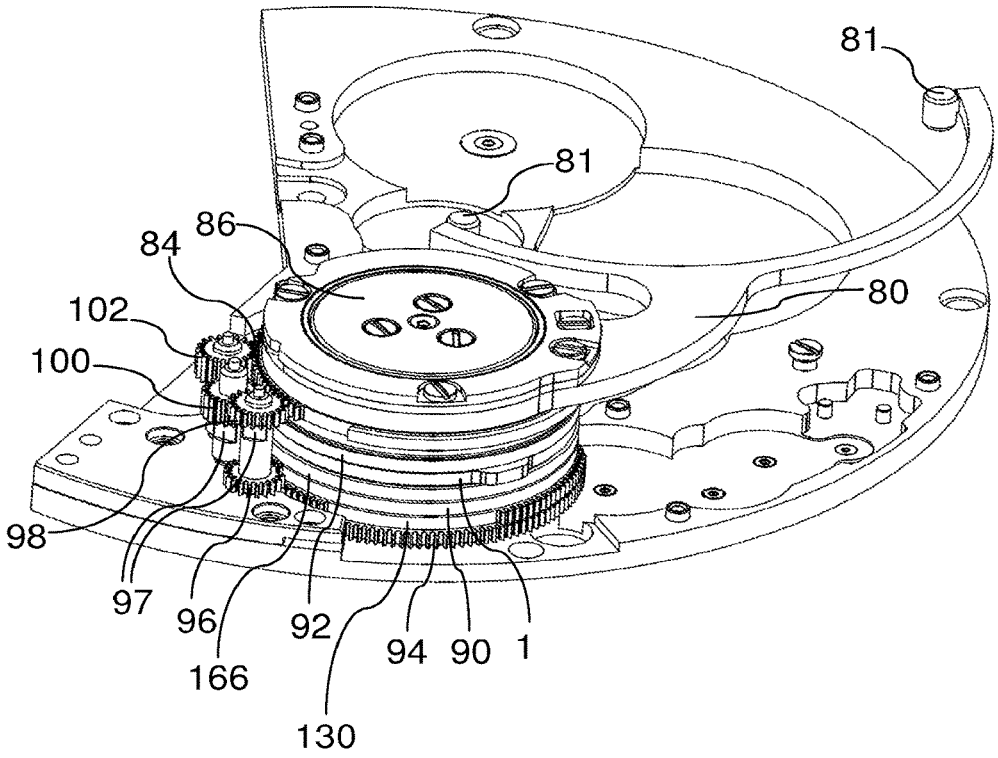
FIG. 6 shows a perspective view of the first means for moving the information carrier and the control means thereof.
Figure 15:
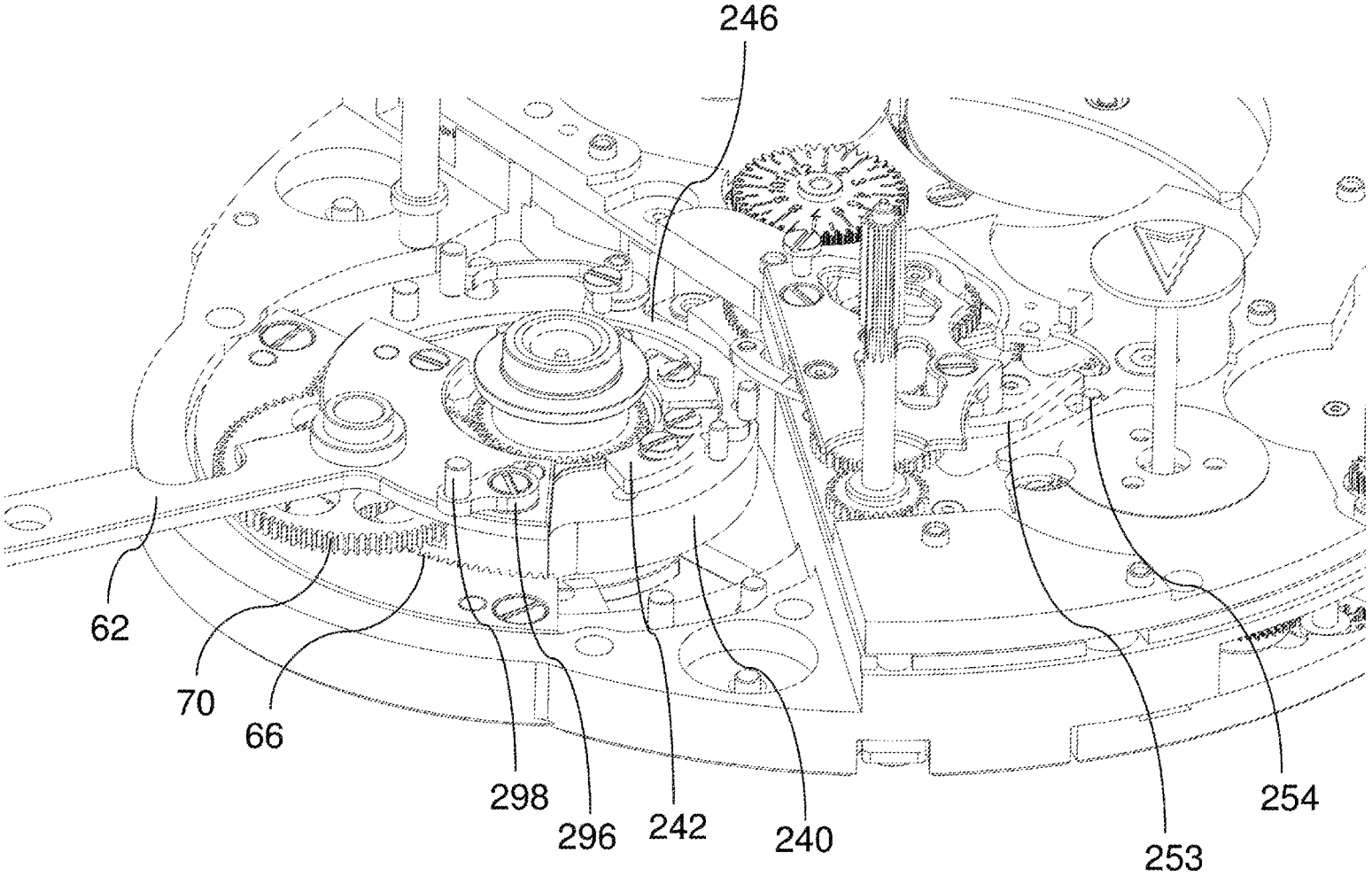
FIG. 15 shows a perspective view of a second safety device for starting the display mechanism.
Figure 16:
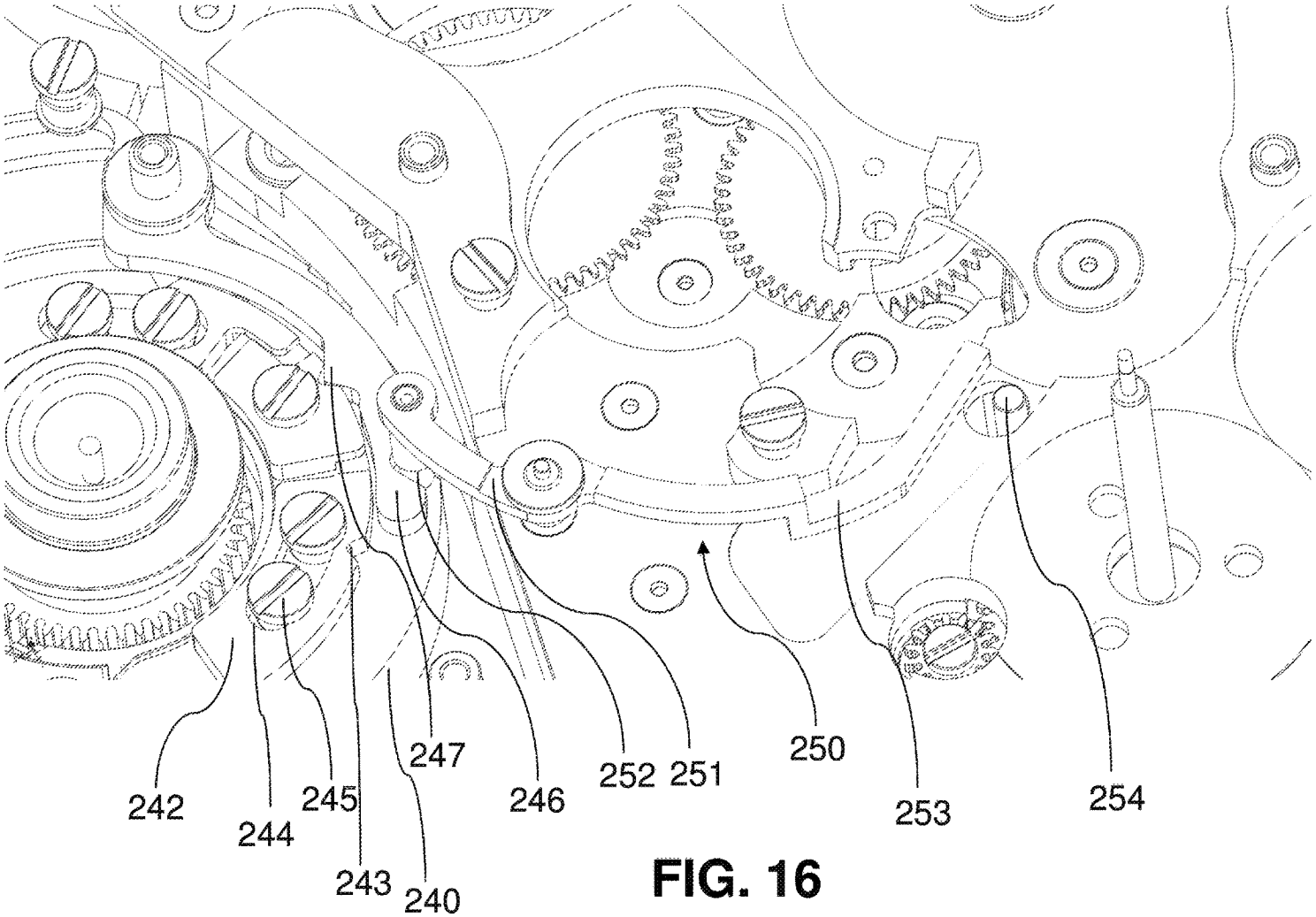
FIGS. 16 and 17 show views of the second safety device for starting the display mechanism, said mechanism being respectively in a normal operating position and in an uncoupled position.
Figure 17:
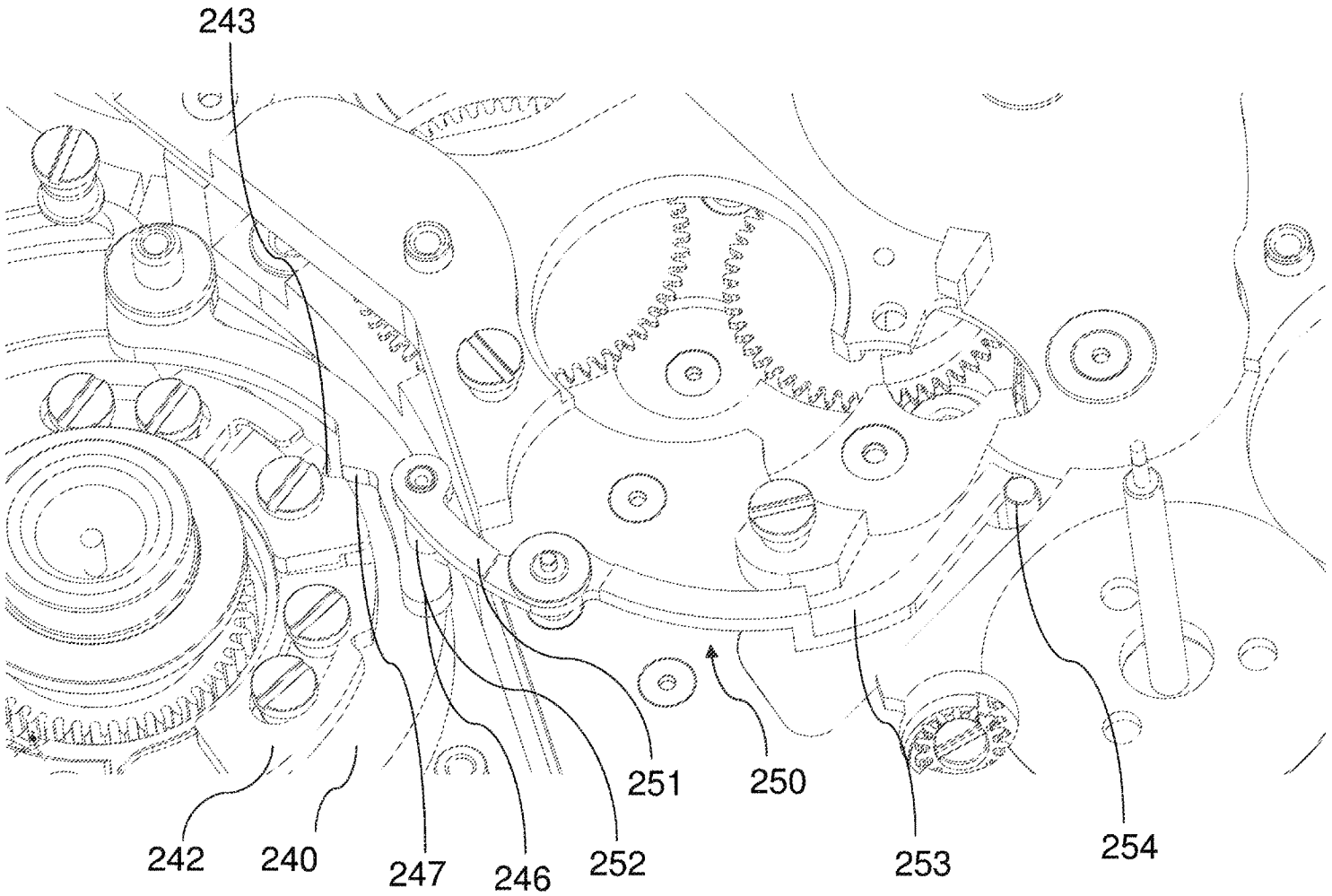

With reference to FIGS. 15 to 17, there is also provided a second safety device for starting the display mechanism of the invention arranged, on the one hand, to allow said mechanism to occupy a normal operating position when magazine 6 is correctly positioned after its movement and on the other hand, to allow said start means to occupy their uncoupled position preventing any motion of first movement means 12 and thus of arm 80 when magazine 6 is not correctly positioned, and more especially when it is not correctly positioned after its movement. With reference to FIGS. 15 and 6, this second safety device for starting the display mechanism includes as many positioning members as information carriers 8, that is to say here three positioning members 242 mounted on plate 240. Each positioning member 242 has the shape of a circular sector, the external peripheral edge including a notch 243 whose function will be described below. Each positioning member 242 includes at its centre an oblong aperture 244 through which are inserted the securing screws 245 of positioning member 242. This makes it possible to precisely adjust the position of each positioning member 242. The display mechanism start safety device also includes a first lever 246 pivotally mounted on the frame and including a positioning beak 247 corresponding to notches 243. Lever 243 is arranged, on the one hand, so that its positioning beak 247 is engaged in one of notches 243 when magazine 6 occupies its normal operating position after its movement and, on the other hand, to cooperate with the display mechanism start means, and more specifically to uncouple push-piece 248 when magazine 6 is not correctly repositioned after its movement and when positioning beak 247 is no longer engaged in one of notches 243 as shown in FIG. 17. To this end, the display mechanism start safety device also includes a second lever 250 pivotally mounted on the frame and including a first arm 251 carrying a first pin 252 arranged to cooperate with the first lever 246 and a second arm 253 arranged to bear on the second pin 254 integral with power reserve lever 272 when positioning beak 247 is not engaged in one of notches 243. Thus, when positioning beak 247 is not engaged in one of notches 243, first lever 246 tips second lever 250 by pushing first pin 252, so that its second arm 253 moves second pin 254 and thus power reserve lever 272. The latter pivots and is then in the same position as when the power reserve is exhausted, as described above. Thus, when positioning beak 247 is not engaged in one of notches 243, barrel 234 remains locked and thus arm 80 cannot move. The cycle is stopped until the user actuates selection arm 62 to correctly position magazine 6 so that positioning beak 247 engages in one of notches 243. Second pin 254 and thus power reserve lever 272 return to position to allow the release of barrel 234 by actuation of push-piece 248.

The arrangement of the various toothed sectors of the control wheels of centralised control unit 88 is such that the second movement means 126 and particularly toothed crown 128 are first of all actuated to lower arbor 124 and thus drive pins 115*a*, 115*b* and indicator pins 117*a*, 117*b* to the low position.

The arrangement of the various toothed sectors of the control wheels of centralised control unit 88 is such that arm 80 is then actuated clockwise, by means of wheel 90 controlling the arm clockwise cooperating with pinion 96, to bring the selected information carrier 8 above platform 10, drive pins 115*a*, 115*b* and indicator pins 117*a*, 117*b* being returned to the low position.

In another variant embodiment of the invention, there may be provided a third safety device arranged to prevent motion of magazine 6 in the case where the selection arm is actuated when arm 80 is no longer positioned in front of magazine 6. In this variant, with reference to FIGS. 18 to 22, the selection arm corresponding to selection arm 62 shown in FIG. 5 is now referenced 277 and is integral here with a ring 278, the assembly being pivotally mounted on the frame, underneath plate 240. Actuation means 40 including pinion 64, inner toothing 66, toothed wheel 70 and toothed wheel 72 integral with nut 74 remain the same as described above.

Figure 18:
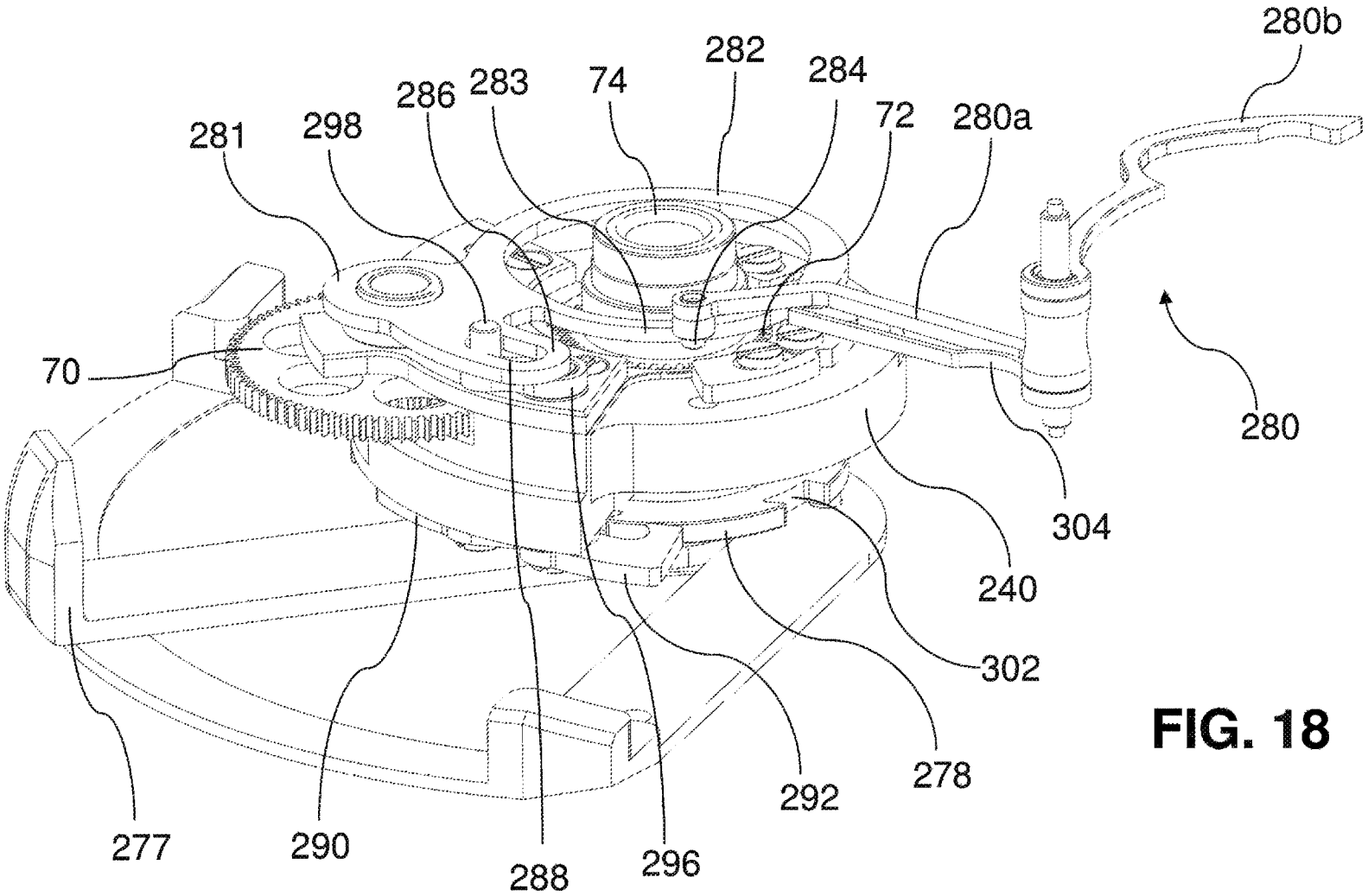
FIGS. 18 and 19 are respectively a perspective view and a bottom view of a third safety device to prevent motion of the magazine when the first movement means are no longer arranged in front of the magazine.
Figure 19:
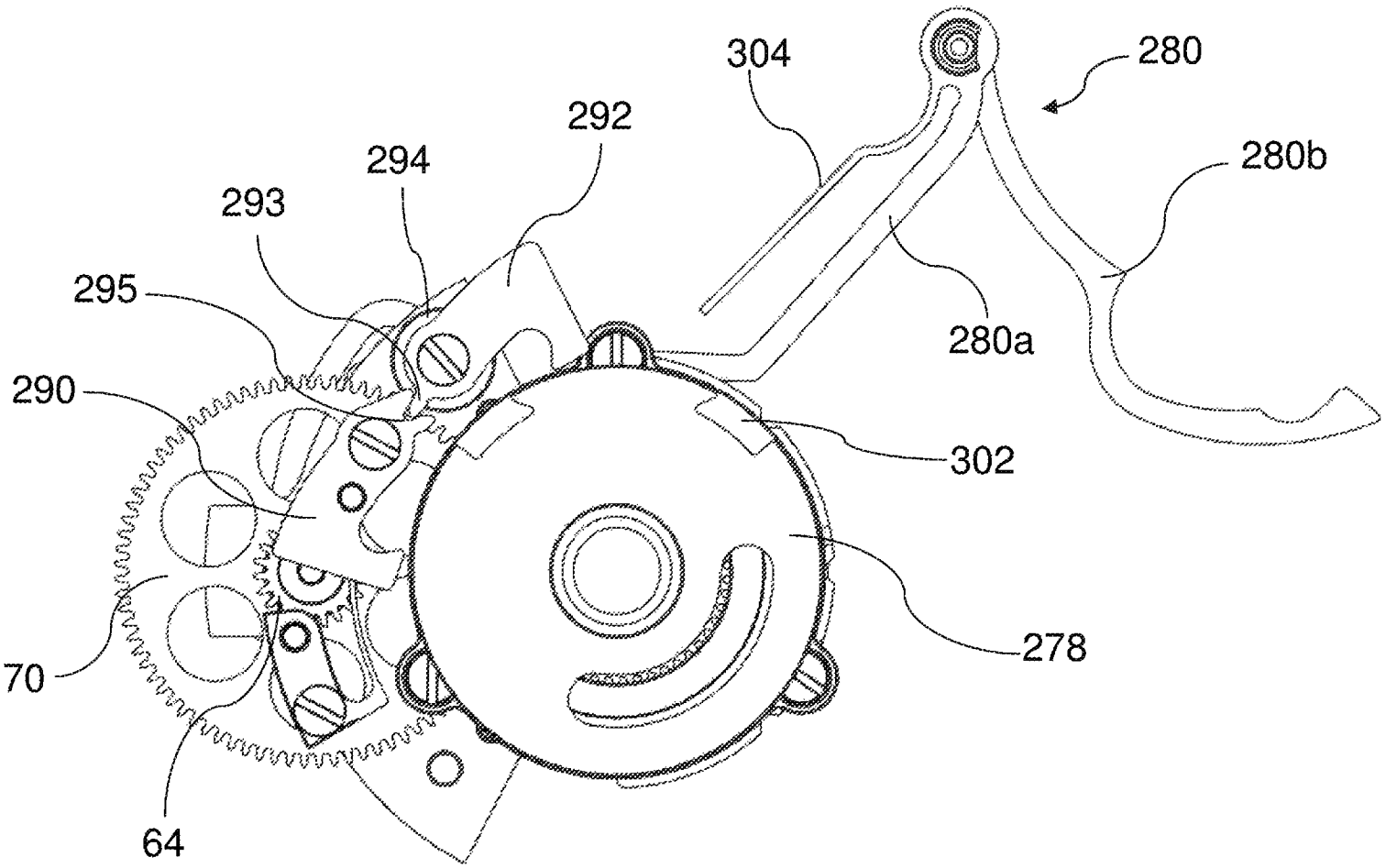
Figure 20:
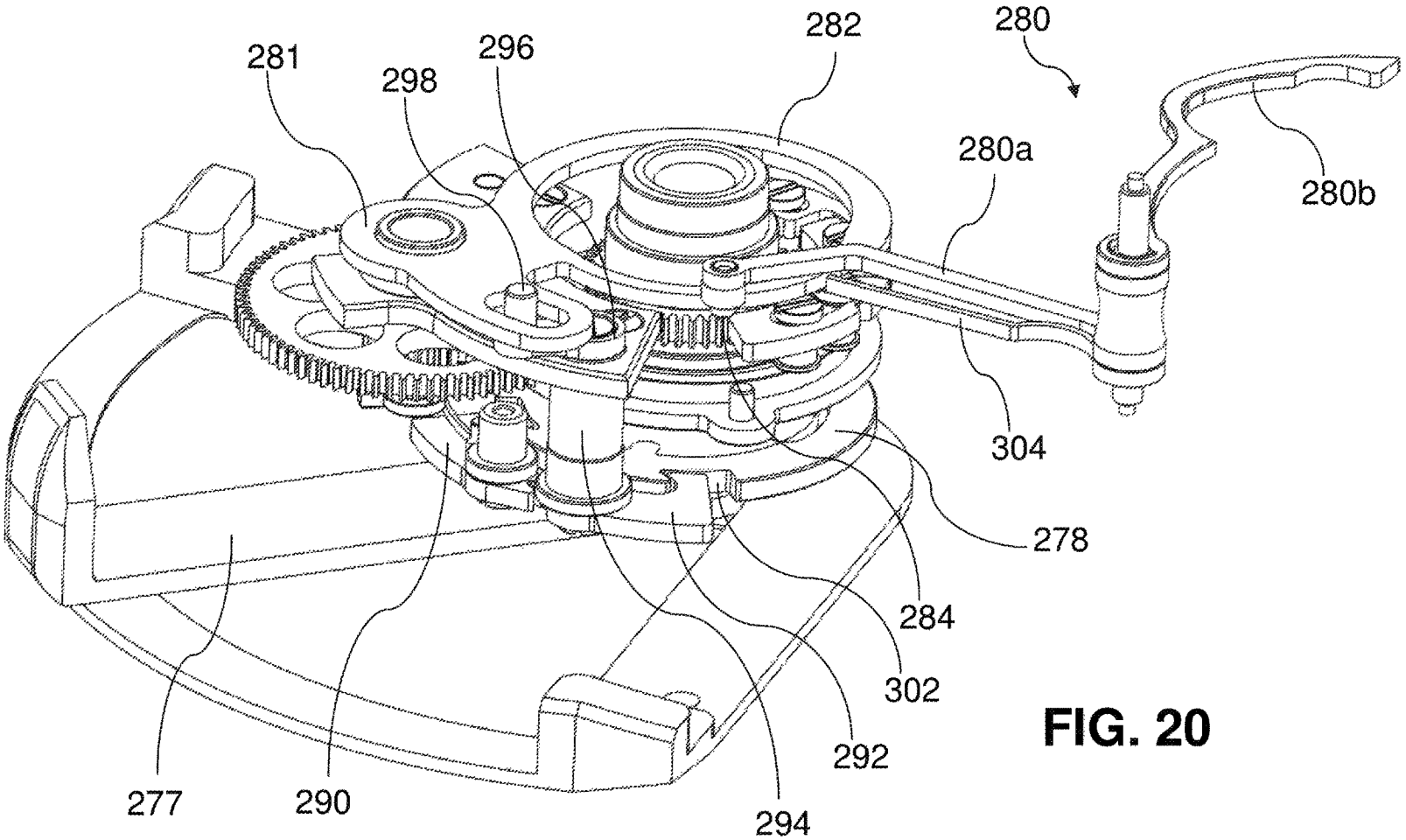
FIGS. 20 and 21 are respectively a perspective view and a bottom view of the third safety device when the first movement means are arranged in front of the magazine.
Figure 21:
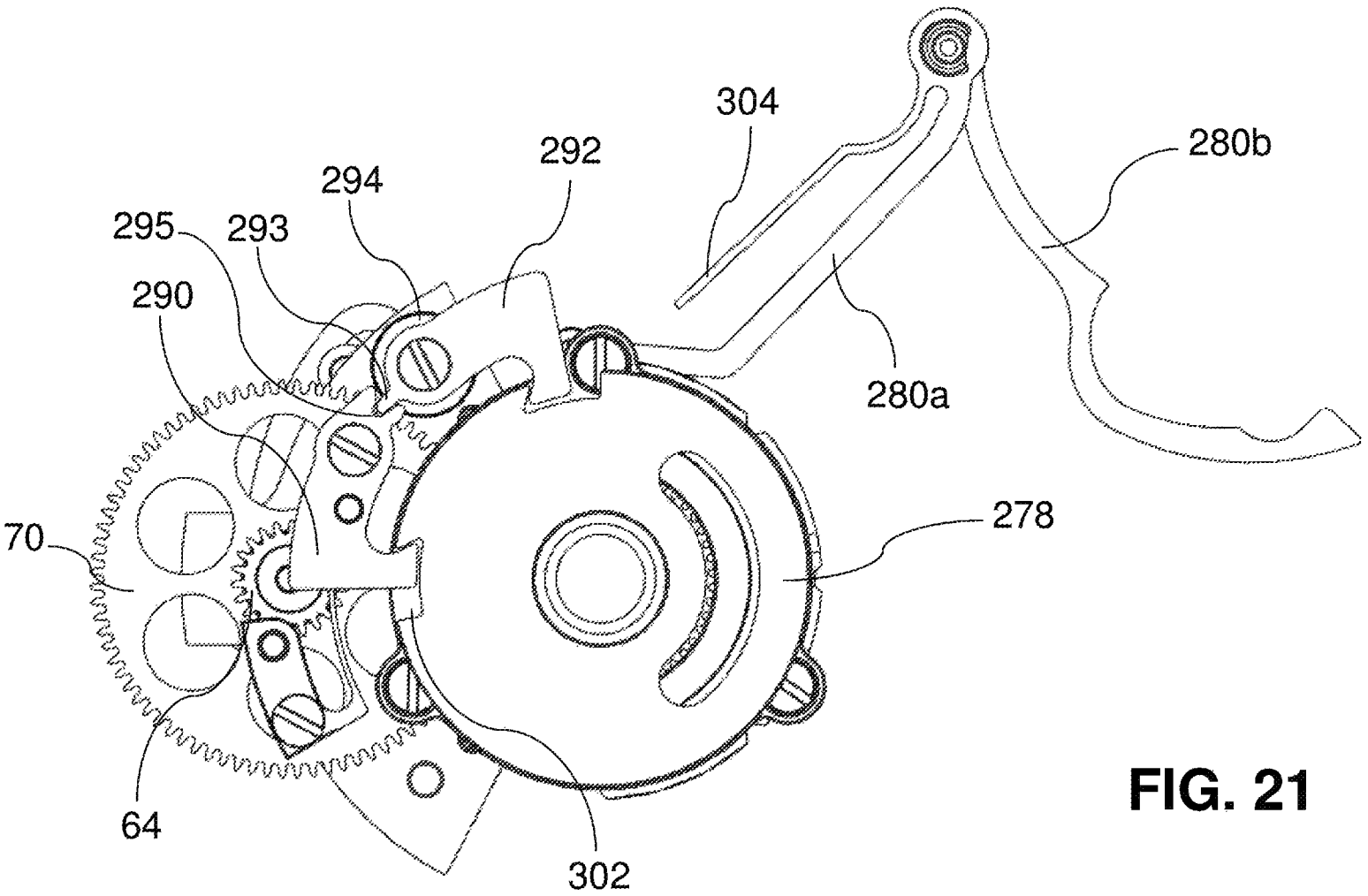
Figure 22:
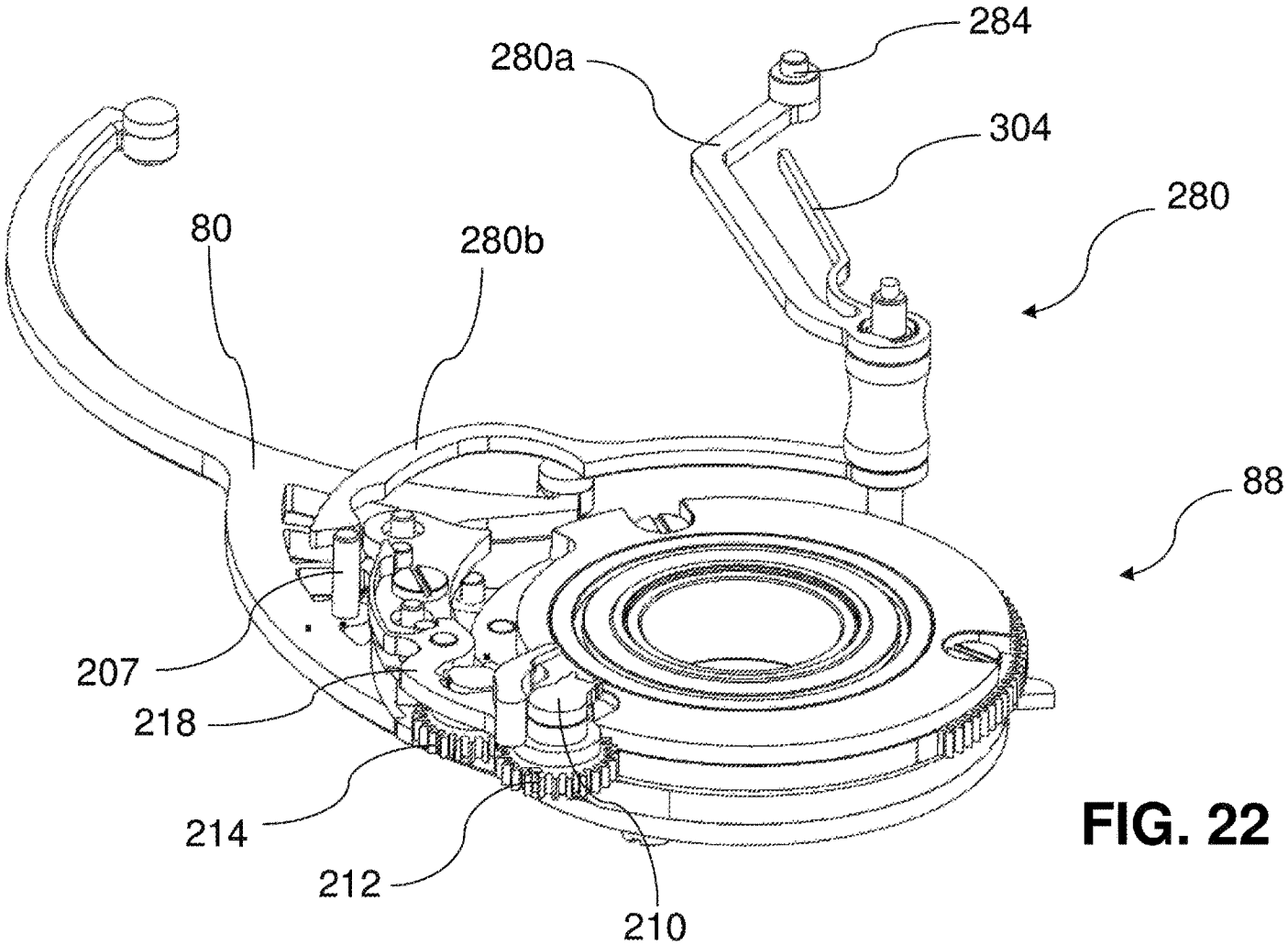
FIG. 22 is a perspective view of the first safety device connected to the lever of the third safety device.

Said safety device includes a lever 280 pivotally mounted on the frame and having two integral branches 280*a*, 280*b*, and a cam 281 pivotally mounted on plate 240. Lever 280 is positioned such that its branch 280*b* can cooperate with a pin 207 (cf. FIGS. 9, 12, 13 and 22) provided on arm 80 when the latter is positioned in front of magazine 6. Cam 281 includes a generally circular portion 282, off-centre with respect to the axis of nut 74 and having a rim 283 arranged to cooperate with a pin 284 provided at the end of branch 280*a* of lever 280. Cam 281 also includes an arm 286 substantially concentric to circular portion 282 and having an oblong aperture 288 whose function will be described below. The third safety device also includes two clamps 290 and 292, clamp 292 being integral with an arbor 294 (cf. FIG. 20) pivotally mounted through plate 240 and clamp 290 being connected to clamp 292 by a finger-piece 293 provided on clamp 292 and engaged in a notch 295 of clamp 290. Arbor 294 carries an arm 296 on which is provided a pin 298 arranged to move inside oblong aperture 288 of cam 281. The third safety device also includes ring 278 whose periphery has two notches 302 respectively arranged to receive a clamp 290, 292. Thus, when arm 80 moves between magazine 6 and platform 10, its pin 207 moves away and releases branch 280*b* of lever 280. Lever 280 pivots under the action of its return spring 304 so that its pin 284 bears on rim 283 of cam 281 and pivots the cam. The pivoting of cam 281 causes the movement of pin 298 in oblong aperture 288 so as to pivot arbor 294 and thus clamp 292. Clamp 292 opens and is released from its notch 302. The other clamp 290 follows the same movement and is released from its notch so that ring 278 is detached from plate 240 and uncoupled, as shown in FIGS. 18 and 19. Consequently, if selection arm 277 is angularly moved, ring 278 rotates in front of clamps 290 and 292 without being able to cooperate therewith. As plate 240 is not driven in rotation, the first actuating means for moving magazine 6 are not actuated. Magazine 6 cannot therefore be moved until arm 80 is positioned in front of magazine 6 again. When arm 80 returns in front of magazine 6, its pin 207 bears again on branch 280*b* of lever 280 so as to move cam 281 and thus pin 298, which causes the rotation of arbor 294 and the closing of clamps 290 and 292 in their notches 302 provided on ring 278, as shown in FIGS. 20 and 21. Ring 278 is thus again integrally connected to plate 240 so that actuation of selection arm 277 causes magazine 6 to move as described above.

The arrangement of the various toothed sectors of the control wheels of centralised control unit 88 is such that the second movement means 126, and in particular toothed crown 128 are then actuated again, so as to raise arbor 124 and thus drive pins 115*a*, 115*b* and indicator pins 117*a*, 117*b* to the high position.

The arrangement of the various toothed sectors of the control wheels of centralised control unit 88 is such that coupling pinion 156 meshing with disc 16 is then actuated until the associated drive pin 115*a*, 115*b* and the associated indicator pin 117*a*, 117*b* are correctly positioned in base 17 of disc 16, which causes the uncoupling of coupling pinion 156. The cycle is then stopped, stopping the rotation of centralised control unit 88.

Disc 16 is henceforth made integral with its associated crown 112*a*, 112*b*, and rotates on the platform at the appropriate speed according to the displayed information. Ring 22 held by arm 80 positioned in front of platform 10, remains stationary, as does glass 24, which allows the information to be read by means of symbols 26 arranged on glass 24. Because crowns 112*a*, 112*b* rotate permanently, even when their associated disc 16 is not positioned on platform 10, the memory of the information is retained and the associated disc 16 is automatically updated when it is placed on platform 10.

When the user again wishes to modify the information carrier in place on platform 10, he actuates the push-piece to restart the barrel and the rotation of centralised control unit 88.

The arrangement of the various toothed sectors of the control wheels of centralised control unit 88 is such that the second movement means 126, and in particular toothed crown 128, are actuated again so as to lower arbor 124 and thus drive pins 115*a*, 115*b* and indicator pins 117*a*, 177*b* to the low position.

The arrangement of the various toothed sectors of the control wheels of centralised control unit 88 is such that arm 80 is then actuated counter-clockwise, by means of wheel 92 controlling the arm counter-clockwise cooperating with pinion 100, to bring the selected information carrier 8 into magazine 6.

The arrangement of the various toothed sectors of the control wheels of centralised control unit 88 is such that the second movement means 126, and in particular toothed crown 128 are then actuated again, so as to raise arbor 124 and thus drive pins 115*a*, 115*b* and indicator pins 117*a*, 117*b* to the high position. Then the cycle stops. As shown in FIG. 4, arm 80 remains in front of magazine 6 and acts as a stop to prevent the information carrier 8 placed level therewith from inadvertently leaving magazine 6.

Thus, the user can modify as he wishes the information carrier 8 positioned on the platform in order to display, in the same place, different pieces of time information.

It is evident that the present invention is not limited to the described embodiment. In particular, the number of crowns may vary.

Further, the various safety devices and the other devices, such as the platform or the control unit may be used independently in mechanisms other than the display mechanism of the invention. For example, the first safety device can be used to secure the position of a chronograph arm. The second safety device can be used in a striking mechanism to prevent the strike being released if the mechanism is in its time-set position. The third safety device can be used in a striking mechanism to prevent time-setting if the user has already released the striking mechanism.

The invention claimed is:

1. A centralized control unit for controlling an arm moving in a clockwise direction and in a counter-clockwise direction, wherein said centralized control unit comprises:

an arbor about which the centralized control unit pivots, wherein said arm is integrally mounted on a toothed actuating wheel as an assembly, and the assembly is mounted to freely rotate about said arbor;

a wheel to control the arm in the clockwise direction;

a wheel to control the arm in the counter-clockwise direction; and a power wheel kinematically connected to an independent barrel to drive the arm, wherein the wheel to control the arm in the clockwise direction, the wheel to control the arm in the counter-clockwise direction, and the power wheel are integrally connected.

2. A centralized control unit for controlling an arm moving in a clockwise direction and in a counter-clockwise direction, wherein said centralized control unit comprises:

an arbor about which the centralized control unit pivots, wherein said arm is integrally mounted on a toothed actuating wheel as an assembly, and the assembly is mounted to freely rotate about said arbor;

a wheel to control the arm in the clockwise direction;

a wheel to control the arm in the counter-clockwise direction; and a power wheel kinematically connected to an independent barrel to drive the arm, wherein the wheel to control the arm in the clockwise direction and the wheel to control the arm in the counter-clockwise direction respectively include a 60° toothed sector arranged such that motion of the arm corresponds to a 60° rotation of said wheel to control the arm in the clockwise direction and said wheel to control the arm in the counter-clockwise direction.

3. The centralized control unit according to claim 2, further comprising:

a reverser set of reverser pinions to rotate the toothed actuating wheel of the arm in the clockwise or counter-clockwise direction, the reverser set including a pinion arranged to cooperate with the toothed sector of the wheel to control the arm in the clockwise direction and a pinion arranged to cooperate with the toothed actuating wheel of the arm, said pinions being integral and mounted to freely rotate, and a pinion mounted to freely rotate and arranged to cooperate, with the toothed sector of the wheel to control the arm in the counter-clockwise direction, and with another pinion mounted to freely rotate and arranged to cooperate with the toothed actuating wheel of the arm.

4. The centralized control unit according to claim 3, wherein the toothed sectors of the wheels to control the arm in the clockwise and counter-clockwise directions are arranged so that when one of the toothed sectors arrives in front of the corresponding pinion of the reverser set, the other toothed sector does not cooperate with the corresponding pinion of the reverser set.

5. The centralized control unit according to claim 2, further comprising:

a safety wheel including two teeth that act like a cam to actuate a jumper to release all pressure on the arm during movement of the arm and to reposition the jumper pressing on the arm.

6. A centralized control unit comprising:

a wheel to control an arm in a clockwise direction, the arm pivotally mounted between a magazine to store information supports and a platform arranged to receive a selected information support;

a wheel to control the arm in a counter-clockwise direction; and a power wheel kinematically connected to an independent barrel to drive the arm, wherein the arm is arranged to move the selected information support between an inactive storage position in the magazine and an active operating position on the platform.

7. The centralized control unit according to claim 6, wherein the wheel to control the arm in the clockwise direction, the wheel to control the arm in the counter-clockwise direction, and the power wheel are integrally connected.

8. The centralized control unit according to claim 6, wherein the wheel to control the arm in the clockwise direction and the wheel to control the arm in the counter-clockwise direction respectively comprise a 60° toothed sector arranged such that motion of the arm corresponds to a 60° rotation of said wheel to control the arm in the clockwise direction and said wheel to control the arm in the counter-clockwise direction.

9. The centralized control unit according to claim 8, further comprising:

a reverser set of reverser pinions to rotate a toothed actuating wheel of the arm in the clockwise or counter-clockwise direction, the reverser set including a pinion arranged to cooperate with the toothed sector of the wheel to control the arm in the clockwise direction and a pinion arranged to cooperate with the toothed actuating wheel of the arm, said pinions being integral and mounted to freely rotate, and a pinion mounted to freely rotate and arranged to cooperate, with the toothed sector of the wheel to control the arm in the counter-clockwise direction, and with another pinion mounted to freely rotate and arranged to cooperate with the toothed actuating wheel of the arm.

10. The centralized control unit according to claim 9, wherein the toothed sectors of the wheels to control the arm in the clockwise and counter-clockwise directions are arranged so that when one of the toothed sectors arrives in front of the corresponding pinion of the reverser set, the other toothed sector does not cooperate with the corresponding pinion of the reverser set.

11. The centralized control unit according to claim 8, further comprising:

a safety wheel including two teeth that act like a cam to actuate a jumper to release all pressure on the arm during movement of the arm and to reposition the jumper pressing on the arm.

12. The centralized control unit according to claim 6, further comprising:

a control wheel of the platform integral with the wheel to control the arm in the clockwise direction and the wheel to control the arm in the counter-clockwise direction, and wherein said control wheel of the platform includes toothed sectors distributed over said control wheel of the platform and that cooperate with a displacement mechanism arranged to move a positioning mechanism arranged to position the selected information support on the platform.

13. The centralized control unit according to claim 6, further comprising:

a coupling control wheel integral with the wheel to control the arm in the clockwise direction and the wheel to control the arm in the counter-clockwise direction, and wherein said coupling control wheel includes a toothed sector so that a rotation of the coupling control wheel causes a rotation of the selected information support until the selected information support is correctly positioned on the platform.

* * * * *